US005875496A

United States Patent [19]

Schaffer

[11] Patent Number: 5,875,496

[45] Date of Patent: Mar. 2, 1999

[54] TOILET DUCT VENTILATION SYSTEM

[76] Inventor: Richard C. Schaffer, 3920 W. Vickery, Fort Worth, Tex. 76107

[21] Appl. No.: 951,602

[22] Filed: Oct. 16, 1997

Related U.S. Application Data

[63] Continuation-in-part of Ser. No. 657,034, May 29, 1996, abandoned, which is a continuation-in-part of Ser. No. 496,140, Jun. 28, 1995, Pat. No. 5,522,093, which is a continuation-in-part of Ser. No. 315,089, Sep. 29, 1994, Pat. No. 5,491,847.

[51] Int. Cl.[6] ..... E03D 9/052

[52] U.S. Cl. ..... 4/213

[58] Field of Search ..... 4/213

[56] References Cited

U.S. PATENT DOCUMENTS 3,849,808 11/1974 Olson et al. ..... 4/213

4,168,553 9/1979 Studer ..... 4/213 X 4,175,293 11/1979 Stephens et al. ..... 4/213 X 5,199,111 4/1993 Antepenko ..... 4/213

*Primary Examiner*—Robert M. Fetsuga

*Attorney, Agent, or Firm*—Arthur F Zobal

[57] ABSTRACT

The ventilation system comprises a manifold having an open bottom with two members adapted to be coupled to either of the two lower ends of the manifold for plugging one of the ends and for allowing the other lower end to be coupled to an exhaust conduit. Also provided is an intake member adapted to fit under the seat of the toilet with a rear end in communication with the interior of the manifold and with the front end located over the bowl of the toilet. In the embodiment disclosed, the intake member has an open bottom with flexible flared side walls to allow the height of the intake member to be varied to fit under the seats of different toilets.

20 Claims, 19 Drawing Sheets

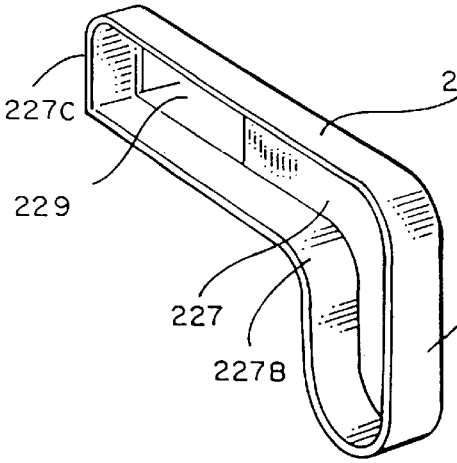
FIG. 10
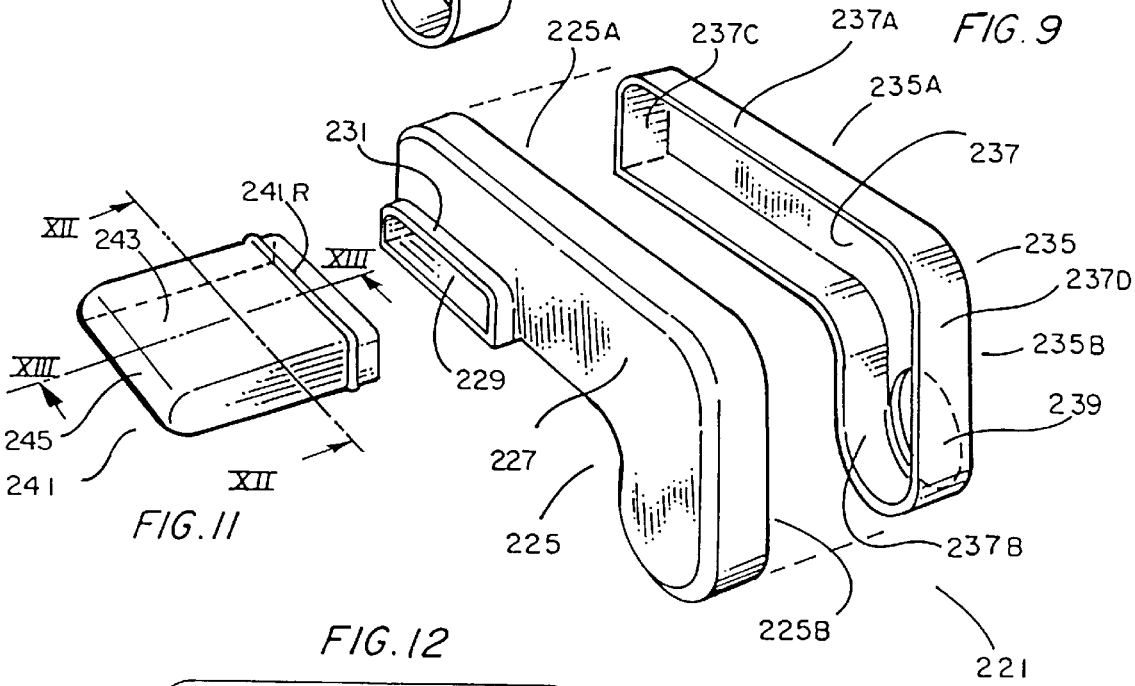
FIG. 9
FIG. 11
FIG. 12
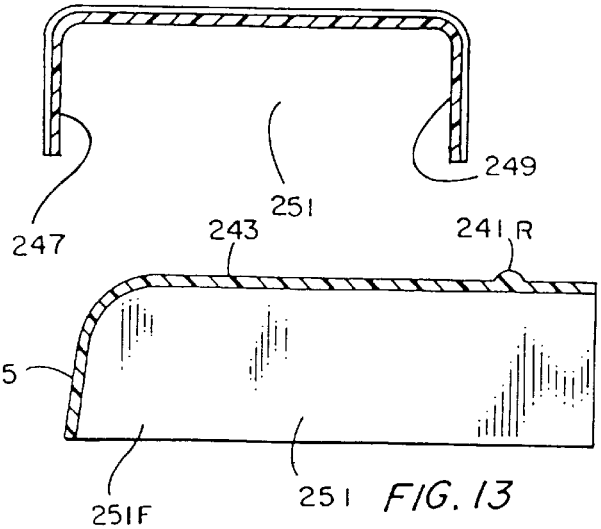
FIG. 13
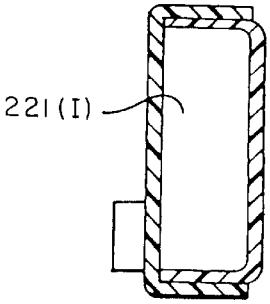
FIG. 14

75
27
27A
13R
27AE
221
13

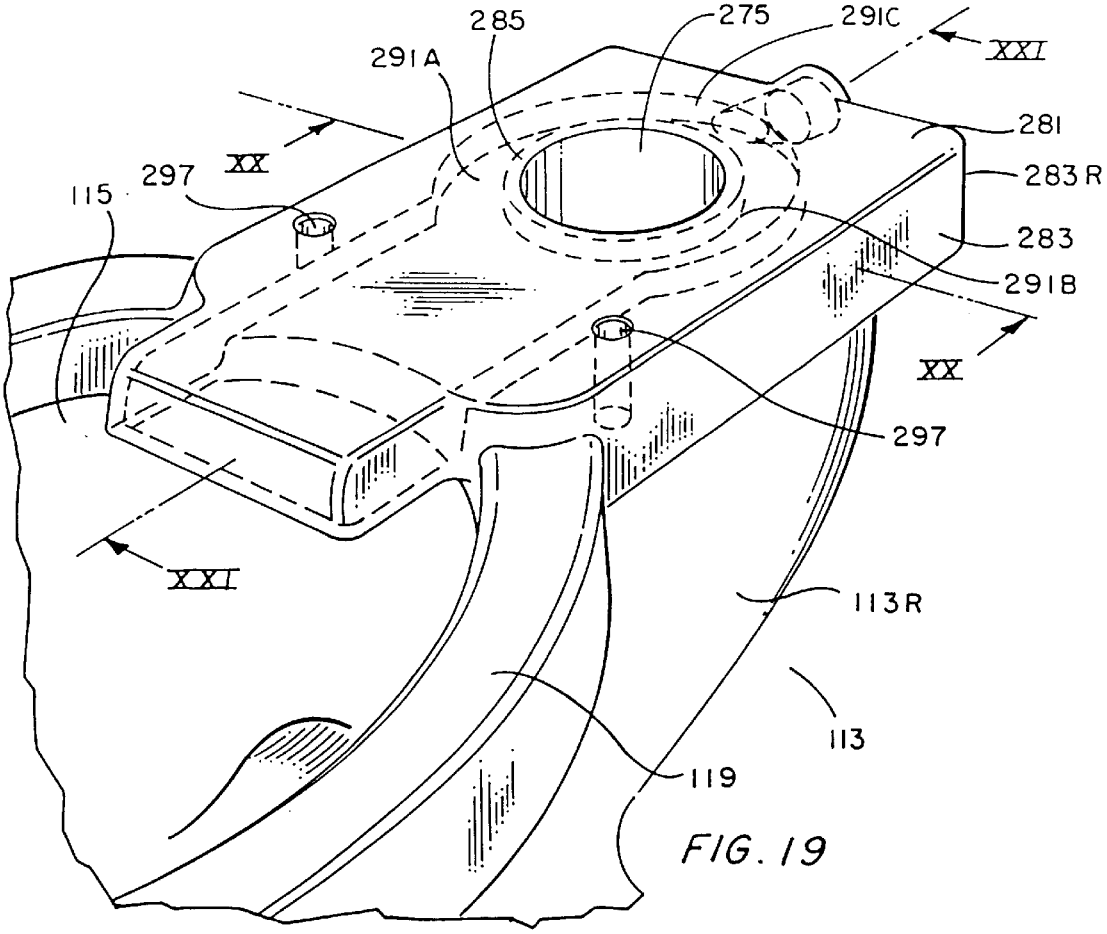
FIG. 19
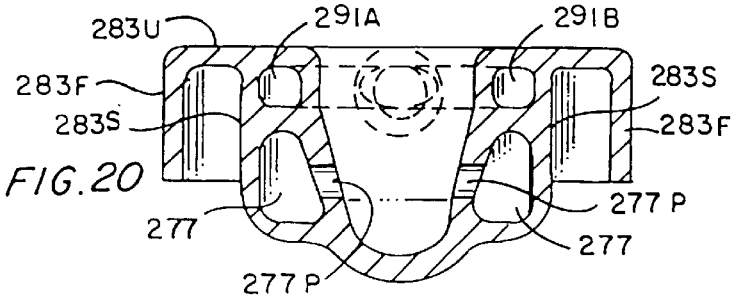
FIG. 20
FIG. 21
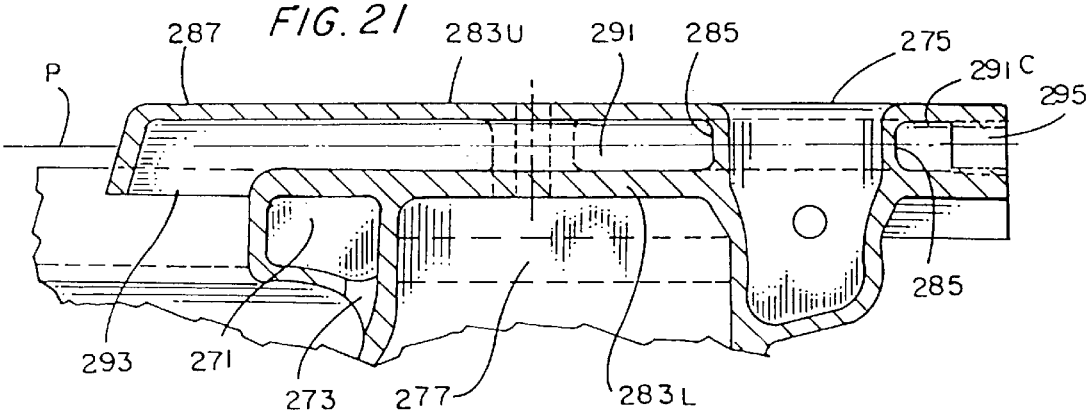

709
704
703
707E
723
723E
719
717
721E
721
707
711

707E
707S
705S
705E
707
705

34
709E
709C
709
707
713
705
715
36
703
713C
35
707E
705E
37
711
711C
711E 711E
711S
711S
711E 709E
709S
709S
709E

TOILET DUCT VENTILATION SYSTEM

BACKGROUND OF THE INVENTION

1. Field of the Invention

This application is a continuation-in-part application of U.S. patent application Ser. No. 08/657,034, filed May 29, 1996, abandoned, which is a continuation-in-part of U.S. patent application Ser. No. 08/496,140, filed Jun. 28, 1995, now U.S. Pat. No. 5,522,093, issued Jun. 4, 1996, which is a continuation-in-part of U.S. patent application Ser. No. 08/315,089, filed Sep. 29, 1994, now U.S. Pat. No. 5,491,847, issued Feb. 20, 1996.

2. Description of the Prior Art

The invention relates to a ventilation system for removing odors from a toilet.

DESCRIPTION OF THE PRIOR ART

Toilets are typically located in small enclosed bathrooms which are susceptible to becoming filled with biological odors each time the toilet is used. Ventilation fans positioned in the ceiling of the bathroom above the toilet are commonly used to draw off odors from the bathroom. Ceiling ventilation fans are not particularly effective, however, since the fan is not located close to the toilet, the source of the odors. The ceiling ventilation fan, therefore, requires a substantial amount of time to remove the odors from the bathroom.

Toilet ventilation systems have been disclosed that are located proximate to the toilet to increase the efficiency of ventilation. For example, U.S. Pat. Nos. 3,849,808; 4,175,293; 4,168,553; and 5,199,111 disclose ventilation systems located near a toilet. These systems, however, are difficult to install, remove, clean.

SUMMARY OF THE INVENTION

The ventilation system comprises a manifold having an open bottom with two members adapted to be coupled to either of the lower ends of the manifold for plugging one of the lower ends and for allowing the other lower end to be coupled to an exhaust conduit. Also provided is an intake member adapted to fit under the seat of the toilet with a rear end in communication with the interior of the manifold and with the front end located over the bowl of the toilet.

In the embodiment disclosed, the intake member has an open bottom with flexible flared side walls to allow the height of the intake member to be varied to fit under the seats of different toilets.

BRIEF DESCRIPTION OF THE DRAWINGS

FIG. 9 is an exploded isometric view of another embodiment of the exhaust manifold or chamber of a toilet ventilation system.

FIG. 10 is a mirror image view of the back side of the front member of the manifold of FIG. 9.

FIG. 11 is an isometric view of another embodiment of the intake member of a toilet ventilation system.

FIG. 12 is a cross-section of FIG. 11 taken along the lines 12—12 thereof.

FIG. 13 is a cross-section of FIG. 11 taken along the lines 13—13 thereof.

FIG. 14 is a cross-section of the assembled manifold of FIG. 9.

FIG. 19 is an isometric view of another embodiment with a vent or manifold integrally formed with the fixture of the toilet.

FIG. 20 is a cross-section of FIG. 19 taken along the lines 20—20 thereof, FIG. 21 is a cross-section of FIG. 19 taken along the lines 21—21 thereof.

DESCRIPTION OF THE PREFERRED EMBODIMENTS

Figure 1:
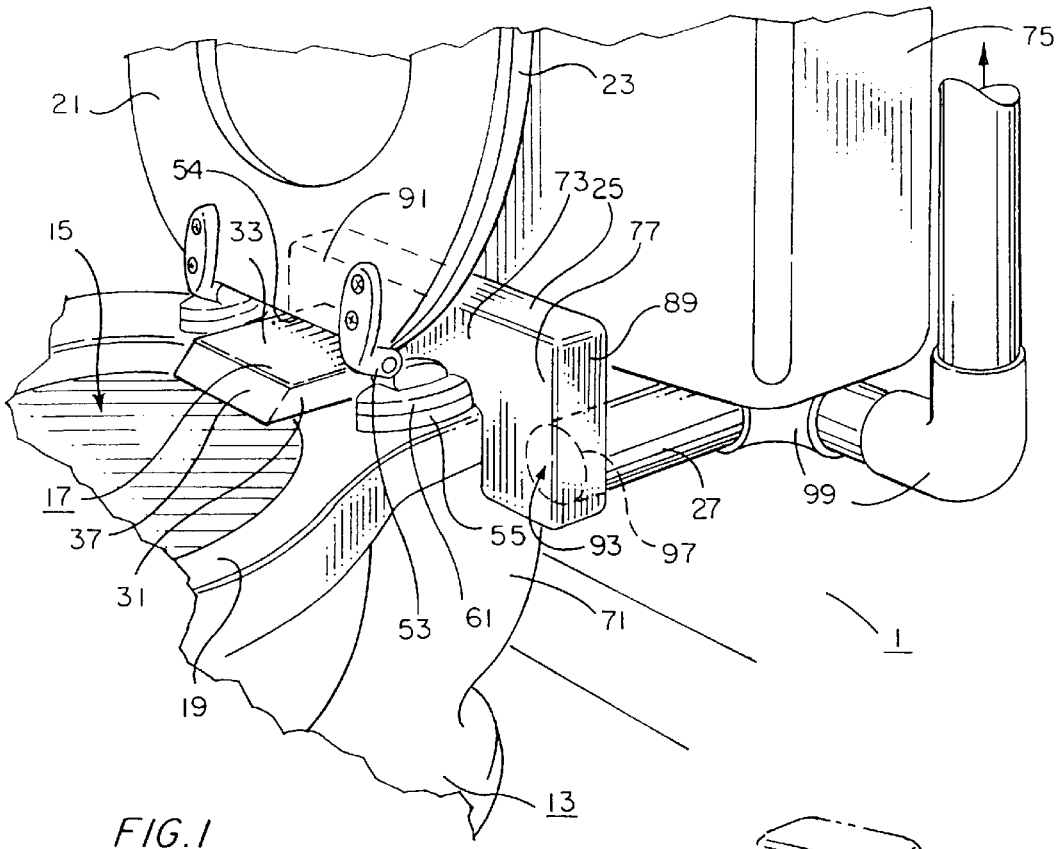
FIG. 1 is an isometric view of a toilet with a toilet ventilation system secured thereto.
Figure 6:
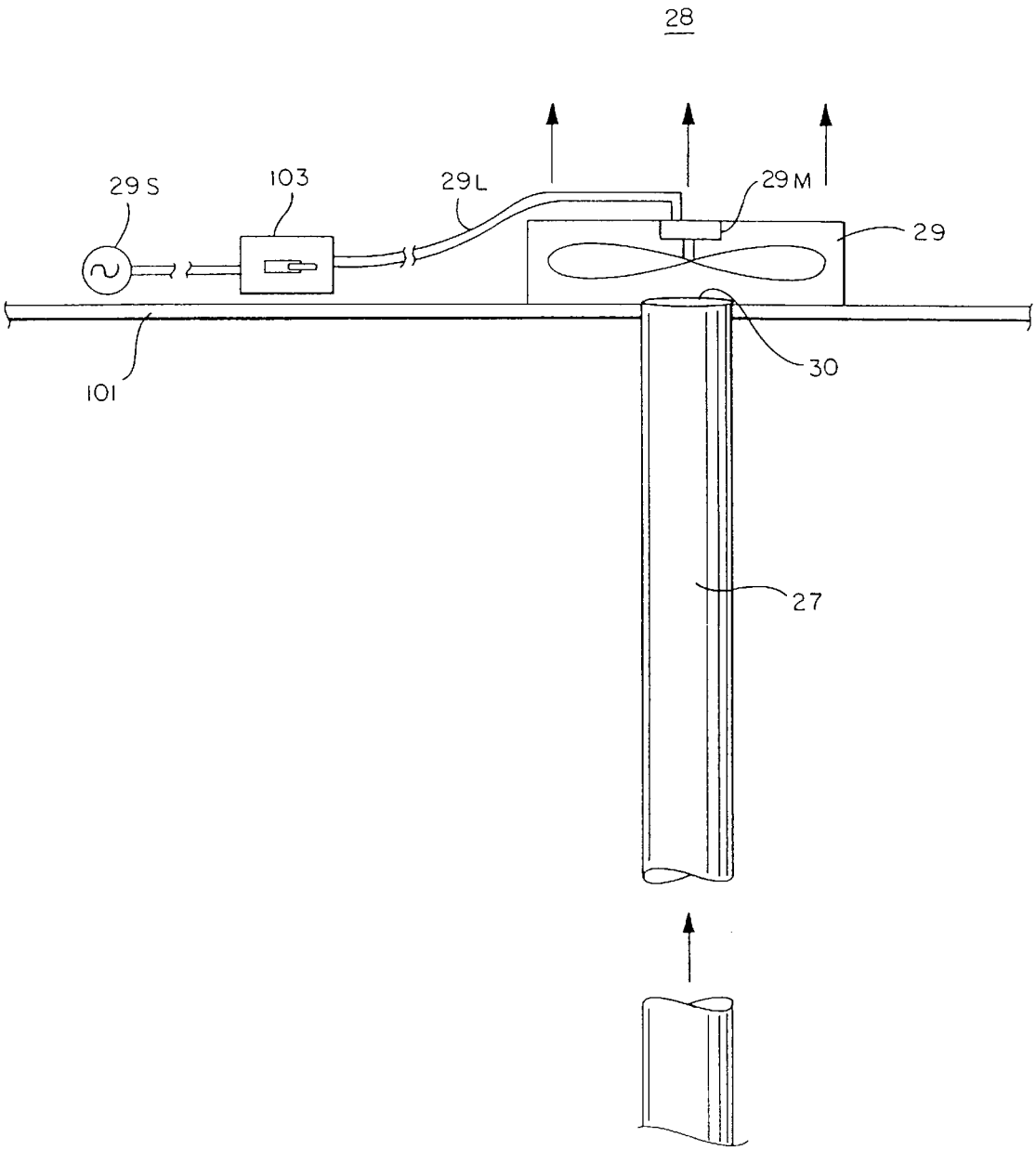
FIG. 6 is a schematic view of the fan of the toilet ventilation system.

Referring now to FIG. 1, the ventilation exhaust system 11 for a toilet is shown positioned on toilet 13. The ventilative exhaust system is positioned close to the toilet bowl 15 of the toilet 13 to efficiently remove biological odors from the toilet area. An exhaust intake member 17 is positioned on the rim 19 of the toilet bowl 15 extending slightly over the bowl 15 to draw odors or fumes from the bowl 15 into the ventilative exhaust system 11. The exhaust intake member 17 extends from the toilet bowl 15 under the seat 21 and lid 23 of the toilet 13 to an exhaust manifold 25. The exhaust manifold 25 couples the exhaust intake member 17 and delivers odors from the intake member 17 to an exhaust ventilation pipe 27 which extends adjacent to the toilet 13. As shown in FIGS. 1 and 6, the exhaust ventilation pipe 27 delivers the odors from the manifold 25 to a ventilation area 28 outside of the area around the toilet. A ventilation fan 29 positioned at a ventilation end 30 of the pipe 27 adjacent the ventilation area 28 draws odors through the ventilation pipe 27, the manifold 25, and the intake member 17.

Figure 2:
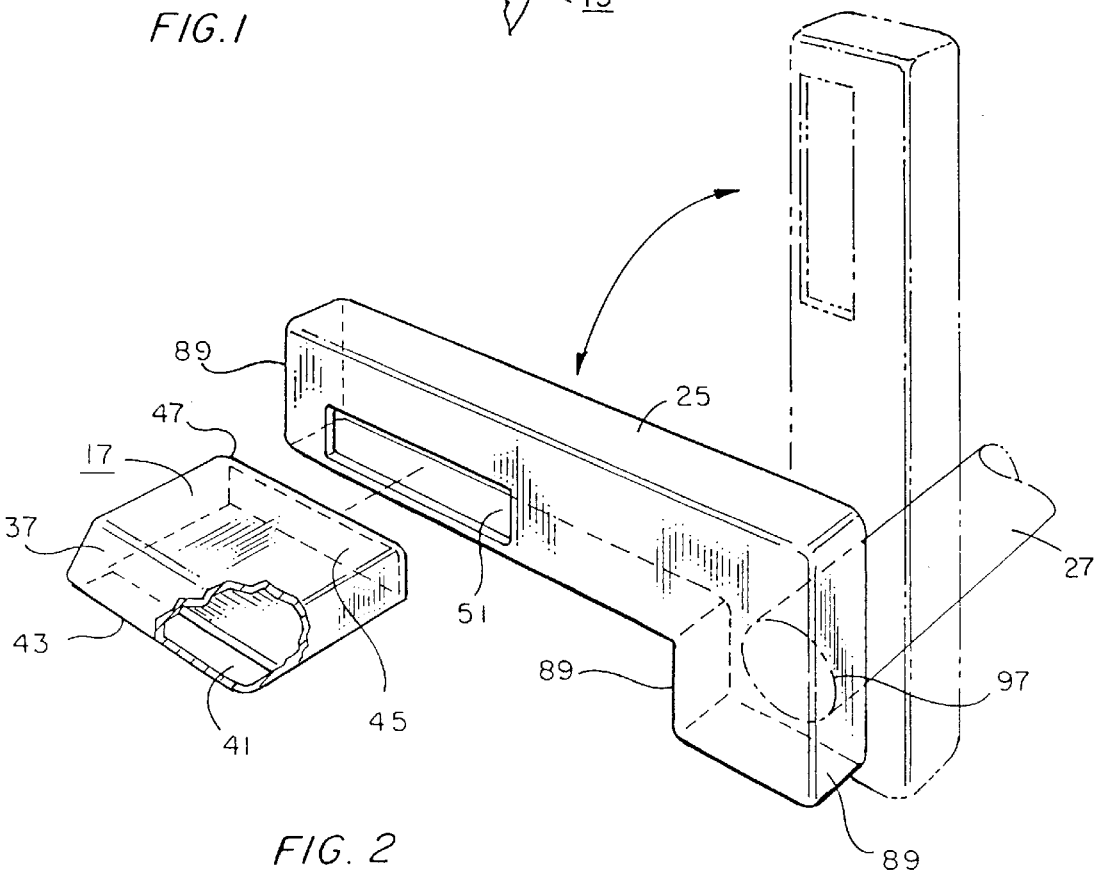
FIG. 2 is an exploded view of the intake member the manifold, and the ventilation pipe, showing the removability of the intake member from the manifold and the rotatability of the manifold about the pipe.

As shown in FIG. 2, the intake member 17 is removably coupled to the manifold 25, and the manifold 25 may be rotated about the ventilation pipe 27 so that the intake member 17 and the manifold 25 and the toilet may be easily cleaned.

Figure 3:
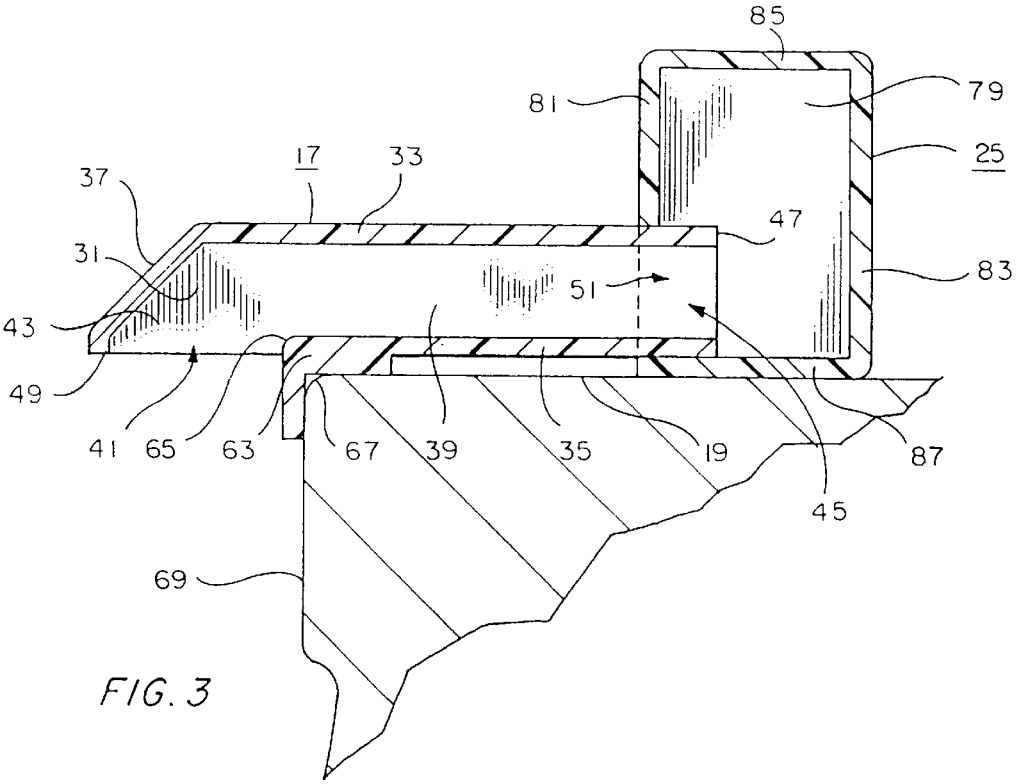
FIG. 3 is a cross-sectional view of the intake member and the manifold viewed across the manifold inlet with the intake member and manifold located on a toilet rim.

Referring now to FIGS. 1 and 3, the intake member 17 is a hollow cartridge through which air may be drawn from the toilet bowl 15 to the manifold 25. The intake member 17 has side walls 31 which extend transversely between and are integrally coupled to a top wall 33, a bottom wall 35, and a front wall 37. The walls 31, 33, 35, and 37 extend about and define a cavity 39 therebetween. In a preferred embodiment, the intake member 17 is formed of a rigid, injection molded plastic.

Air and biological fumes may be drawn through openings in the intake member 17. Referring to FIGS. 2 and 3, the member 17 has an intake opening 41 at an intake end 43 communicating with cavity 39, and an exhaust opening 45 at an exhaust end 47 of the intake member 17 also communicating with cavity 39. Air may freely flow through the intake member 17 along a path defined by the intake opening 41, the cavity 39, and the exhaust opening 45.

The intake end 43 of the intake member 17 is positioned over the toilet bowl 15 to draw odors directly out of the bowl 15. The intake opening 41 faces into the toilet bowl 15 extending from side wall 31 to side wall 31 between the front edge 49 of the front wall 37 and the bottom wall 35. The intake opening 41 is located downward facing the toilet bowl 15 for maximum efficiency in removing odor from the toilet bowl 15 which also prevents spillage of liquids from above into the member 17 into the cavity 39. The front wall 37 is angled back from its front edge 49 to the top wall 33 so that the intake end 43 may be unobtrusively extended over the toilet bowl 15.

The exhaust end 47 of the intake member 17 is coupled to the manifold 25 to deliver air and odors drawn through the intake opening 41 into the manifold 25. The exhaust end 47 has a rectangular cross-section formed by walls 31, 33, and 35 with the exhaust opening 45 and cavity 39 extending between the walls 31, 33, and 35. The exhaust end 47 slidably fits into a rectangular manifold inlet 51 to position the exhaust opening within the manifold 25 so odors may be drawn from the intake member 17 into the manifold 25. The manifold inlet 51 is only slightly larger than the exhaust end 47 of the intake member 17 so that the exhaust end 47 is held within the manifold 25 by a friction fit within the manifold inlet 51. As shown in FIG. 2, the exhaust end 47 may be slidably removed from the manifold inlet 51 so that the intake member 17 may be removed from the manifold 25 for cleaning.

Figure 4:
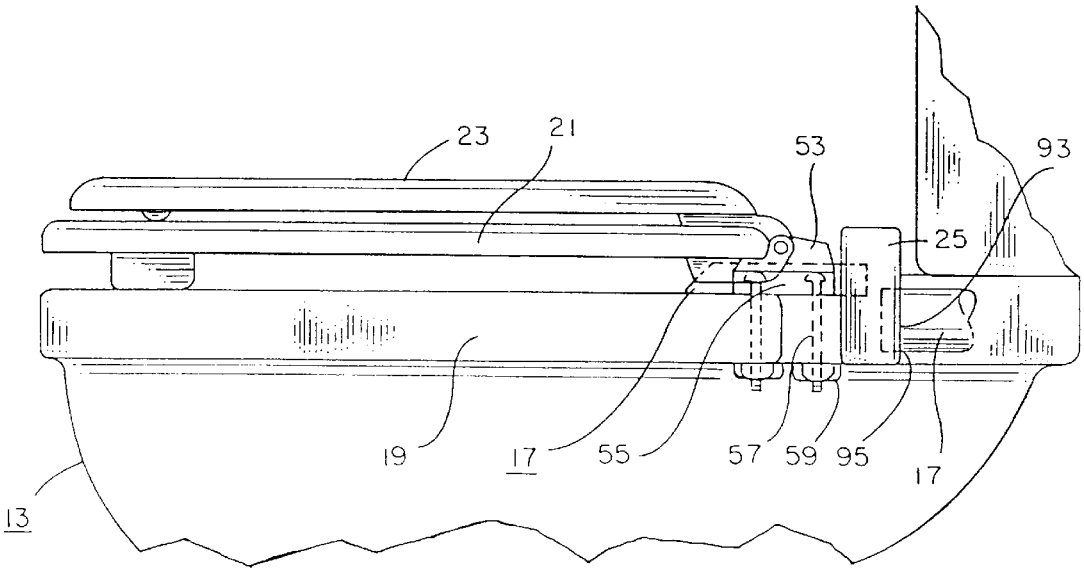
FIG. 4 is a side view of a toilet with the seat and lid closed, having the toilet ventilation system secured on the toilet.

Referring now to FIGS. 1 and 4, the intake member 17 extends from the toilet bowl 15 to the manifold 25 beneath the seat 21 and lid 23 of the toilet 13. The intake member 17 is positioned extending between the hinges 53 which pivotally couple the seat 21 and lid 23 to the toilet 13. The width of the intake member 17 between its side walls 31 permits the intake member 17 to fit between the hinges 53 while providing a sizable gap between the side walls 31 at the intake opening 41 through which odors may be drawn. The intake member 17 does not interfere with movement of the seat 21 and lid 23, and the seat 21 and lid 23 may be placed in an open position (FIG. 1) or a closed position (FIG. 4) with the intake member 17 on the toilet 13.

Hinge spacers 55 may be positioned between the hinges 53 and the toilet 13 to provide clearance for the intake member 17 to extend beneath the seat 21 and lid 23 of the toilet 13. As shown in FIG. 4, the hinge spacers 55 are coupled to the toilet 13 by connector bolts 57 which extend through the toilet rim 19 and are fastened thereto by nuts 59 underneath the toilet rim 19. The connector bolts 57 may be used to fasten the hinges 53 to the hinge spacers 55 and the toilet 13, or the hinges 53 may be attached to the hinge spacers 55 with separate bolts or screws. In a preferred embodiment the hinge spacers 55 are formed of a rigid plastic having a shape corresponding to the shape of the base 61 of the hinges 53 (See FIG. 1).

In a preferred embodiment, as shown in FIG. 3, the intake member 17 has a lip 63. The lip 3 is formed in the bottom wall 35 at the forward edge 65 of the bottom wall 35 adjacent the intake opening 41. The lip 63 extends transverse to the bottom wall 35 over the edge 67 of the toilet bowl rim 19 to abut a rear portion of the toilet bowl wall 69 thereby preventing movement of the intake member 17 towards the manifold 25. The lip 63 also extends along a portion of the bottom wall 35 below the bottom wall 35 to maintain the intake member 17 in a level orientation in the manifold inlet 51.

Referring now to FIGS. 1 and 3, the manifold 25 is a hollow "L" shaped member through which air and odors may be drawn from the intake member 17, located centrally on the toilet 13, to the ventilation pipe 27, located at the side 71 of the toilet 13. An upper portion 73 of the manifold 25 extends across the toilet 13 between the seat 21 and the toilet tank 75 from a central location behind the seat 21 to the side 71 of the toilet 13. A side portion 77 of the manifold 25 is integrally coupled to the upper portion 73 at the side 71 of the toilet 13 and extends transverse to the upper portion 73 downward along the toilet side 71. The side portion 77 of the manifold 25 receives the ventilation pipe 27. In a preferred embodiment the manifold 25 is formed of a rigid plastic material. The manifold 25 has front and rear walls 81 and 83 coupled by top, bottom, and side walls 85, 87, and 89 the later of which extend transversely between the front and rear walls 81 and 83. The walls 81, 83, 85, 87 and 89 form the manifold cavity 79. The manifold inlet 51 is located extending through the front wall 81 of the manifold 25 communicating with the manifold cavity 79 at an intake end 91 in the upper portion 73 of the manifold 25. A manifold outlet 93 is located extending through the rear wall 83 of the manifold 25 communicating with the manifold cavity 79 at an outlet end 95 of the manifold 25. Air and odors may freely flow through the manifold 25 along a path defined by the manifold inlet 51, manifold cavity 79, and manifold outlet 93.

The manifold 25 is coupled between the intake member 17 and the ventilation pipe 27. As discussed above, the exhaust end 47 of the intake member 17 is slidably located in the manifold inlet 51. The manifold inlet 51 is positioned low in the front wall 81 of the upper portion 73 of the manifold 25 so the intake member 17 may extend beneath the seat 21 and the lid 23 while located in the manifold inlet 51. The exhaust opening 45 of the intake member 17 communicates with the manifold cavity 79 so that air and odors may be drawn from the intake member 17 into the manifold cavity 79 through the exhaust opening 45.

The ventilation pipe 27 has an inlet end 97 which is coupled to the manifold outlet 93 to receive air and odors drawn through the manifold cavity 79. The manifold outlet 93 is a circular aperture centered in the rear wall 83 at the outlet end 95 of the manifold 25 positioned below the toilet tank 75 so that the ventilation pipe 27 may be coupled therein. The inlet end 97 of the ventilation pipe 27 is cylindrical and has a slightly smaller diameter than the diameter of the manifold outlet 93. The inlet end 97 of the ventilation pipe 27 is located within the manifold outlet 93 and is held within the manifold outlet 93 by a friction fit. As shown in FIG. 2, the manifold 25 may be rotated about the inlet end 97 of the ventilation pipe 27 when the intake member 17 has been slidably removed from the manifold inlet 51. The rotated manifold 25 may be easily cleaned and then rotated back into its initial position.

As shown in FIGS. 1 and 6, the ventilation pipe 27 extends from the manifold outlet 93 to the ventilation fan 29 to deliver air and odors from the manifold 25 to the fan 29. The ventilation pipe 27 is positioned unobtrusively adjacent the toilet 13 extending from the manifold 25 beneath the toilet tank 75. Elbow joints 99 in the pipe 27 permit the pipe 27 to be situated about the tank 75. The pipe 27 extends from beneath the toilet tank 75 either through the ceiling 101 above the toilet 13 (shown in FIGS. 1 and 6) or through the wall adjacent to the toilet (not shown) to the ventilation end 30 of the pipe 27. The ventilation end 30 of the pipe 27 is coupled to the fan 29 so the fan 29 may draw air and odors through the pipe 27. The pipe 27 may be formed of rigid PVC piping or corrugated flexible tubing.

The ventilation fan 29 draws air and odors through the intake member 17, the manifold 25, and the ventilation pipe 27 and expels the air and odors into a ventilation area 28. The fan 29 is attached to a wall or a ceiling 101 adjacent the ventilation area 28 positioned to expel air drawn through the fan 29 into the ventilation area 28. The ventilation area 28 will typically be the outside of the room or building in which the toilet 13 is located.

The fan 29 is a conventional, commercially available electrical fan capable of drawing sufficient suction through the intake member 17, manifold 25, and pipe 27 to effectively remove biological odors from the toilet 13. A conventional on-off switch 103 is provided to control the flow of current on leads 29L from source 29S to the electric motor 29M which drives the fan 29. The switch 103 is located in a position near the toilet 13 so that the switch 103 may be easily accessed to turn the fan 29 on and off as needed.

In operation, biological odors may be removed from the toilet 13 by placing the switch 103 in an "on" position to start the fan 29. The suction from the fan 29 causes odors in the toilet 13 to be drawn into the intake member 17 through the intake opening 41. The odors are then drawn through the intake member 17 and into the manifold 25 through the coupled exhaust opening 45 and manifold inlet 51. The odors are pulled through the manifold 51 into the ventilation pipe 27 through the coupled manifold outlet 93 and inlet end 97 of the pipe 27. The fan 29 draws the odors through the ventilation end 30 of the pipe 27 and expels them into the ventilation area 28. After the odors have been removed from the toilet 13 by the ventilation system 11, the switch 103 is placed in an "off" position to turn the fan 29 off.

As shown in FIG. 2, the ventilation system 11 may be cleaned after a significant period of use. In order to clean the system 11, the exhaust end 47 of the intake member 17 is slid out of the manifold intake 51 so that the intake member 17 and the toilet may be cleaned. After the intake member 17 has been removed, the manifold 25 is rotated about the pipe 27 in the manifold outlet 93 to position the manifold 25 for cleaning and to allow the toilet to be cleaned. After the intake member 17, the manifold 25 and the toilet have been cleaned, the ventilation system 11 is reassembled by rotating the manifold 25 back into its operating position and reinserting the intake member 17 into the manifold inlet 51 to position the intake member 17 on the toilet bowl rim 19.

Figure 7:
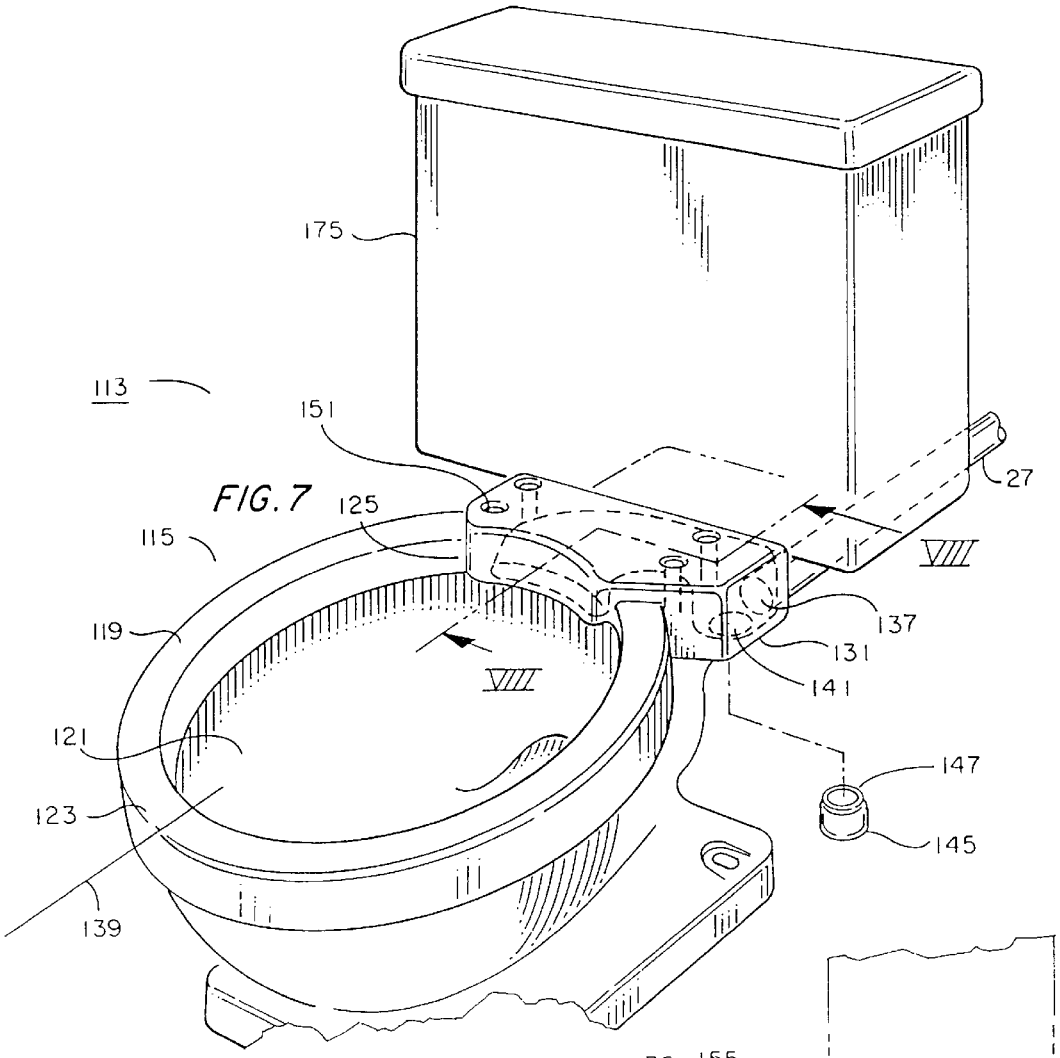
FIG. 7 is an isometric view of an odor vent system integral with a toilet.
Figure 8:
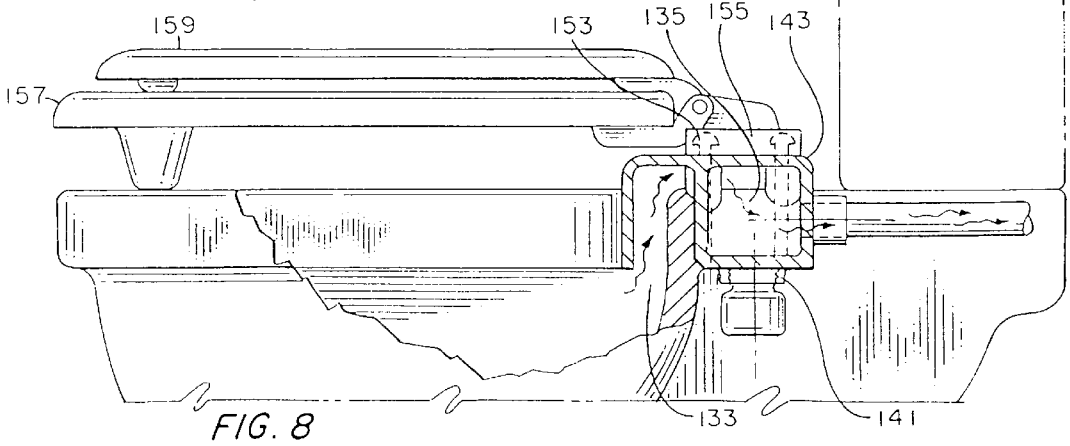
FIG. 8 is a cross-section of FIG. 7 taken along the lines 8—8 thereof.

Referring now to FIGS. 7 and 8, the toilet 113 comprises a modified toilet bowl 115 and a water tank 175. The bowl has an upper rim 119 surrounding a lower cavity 121 with a front end 123 and a rear end 125. Integrally coupled to the rear end of the rim 119 is a manifold or vent 131 having a front inlet 133 leading to a chamber 135 and a rear outlet 137 in fluid communication with the chamber and located to one side of the center line 139 of the bowl. An exhaust pipe 27 is coupled to the outlet 137. The pipe 27 leads to an exhaust fan 29 as described previously. As shown the inlet 133 extends downward toward the cavity 121. A threaded opening 141 is formed through the wall 143 of the manifold 131 at the bottom for receiving a container 145 or sump having a threaded rim 147 which can be removably screwed into the threaded opening 141. The purpose of the container 145 is to receive any liquids that may pass to the chamber 135. In addition by removing the container or receptacle 145, water can be injected into the manifold either by way of the inlet 133 or opening 141 for cleaning the inside walls of the manifold.

The manifold 131 may be formed of ceramic material as that of the bowl 115. The manifold 131 may be molded or cast to the rim and bowl when the bowl is formed such that the bowl and manifold form a single unit formed together or the manifold 131 may be fixedly attached to the rim of an existing toilet bowl with suitable glue and/or bolts. The manifold 131 has suitable holes 151 formed through the walls thereof for receiving bolts 153 for use for attaching a base member 155 thereto to which the seat 157 and lid 159 are hinged.

Figure 15:
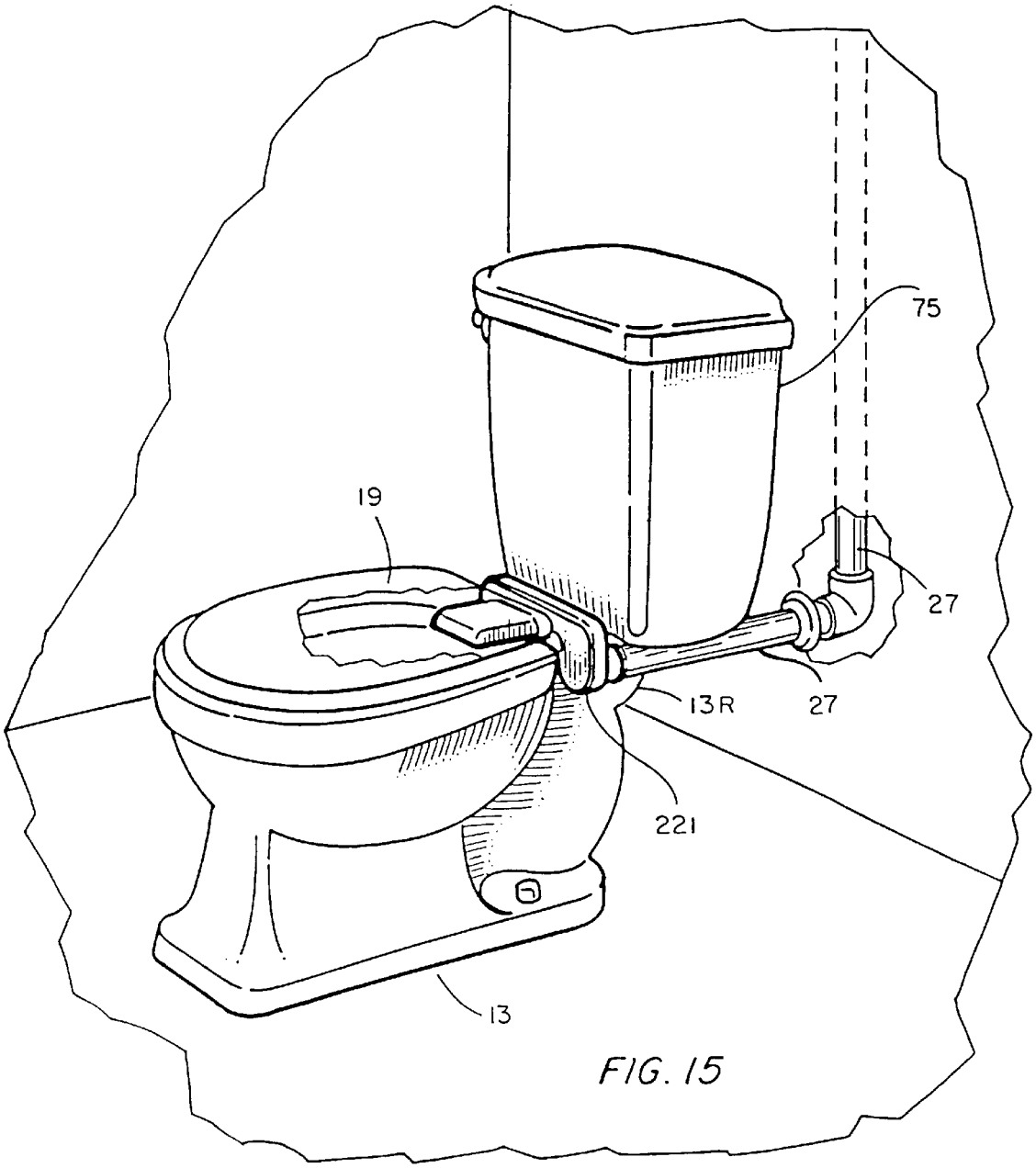
FIG. 15 illustrates the components of FIGS. 9–13 installed on a toilet.
Figure 16:
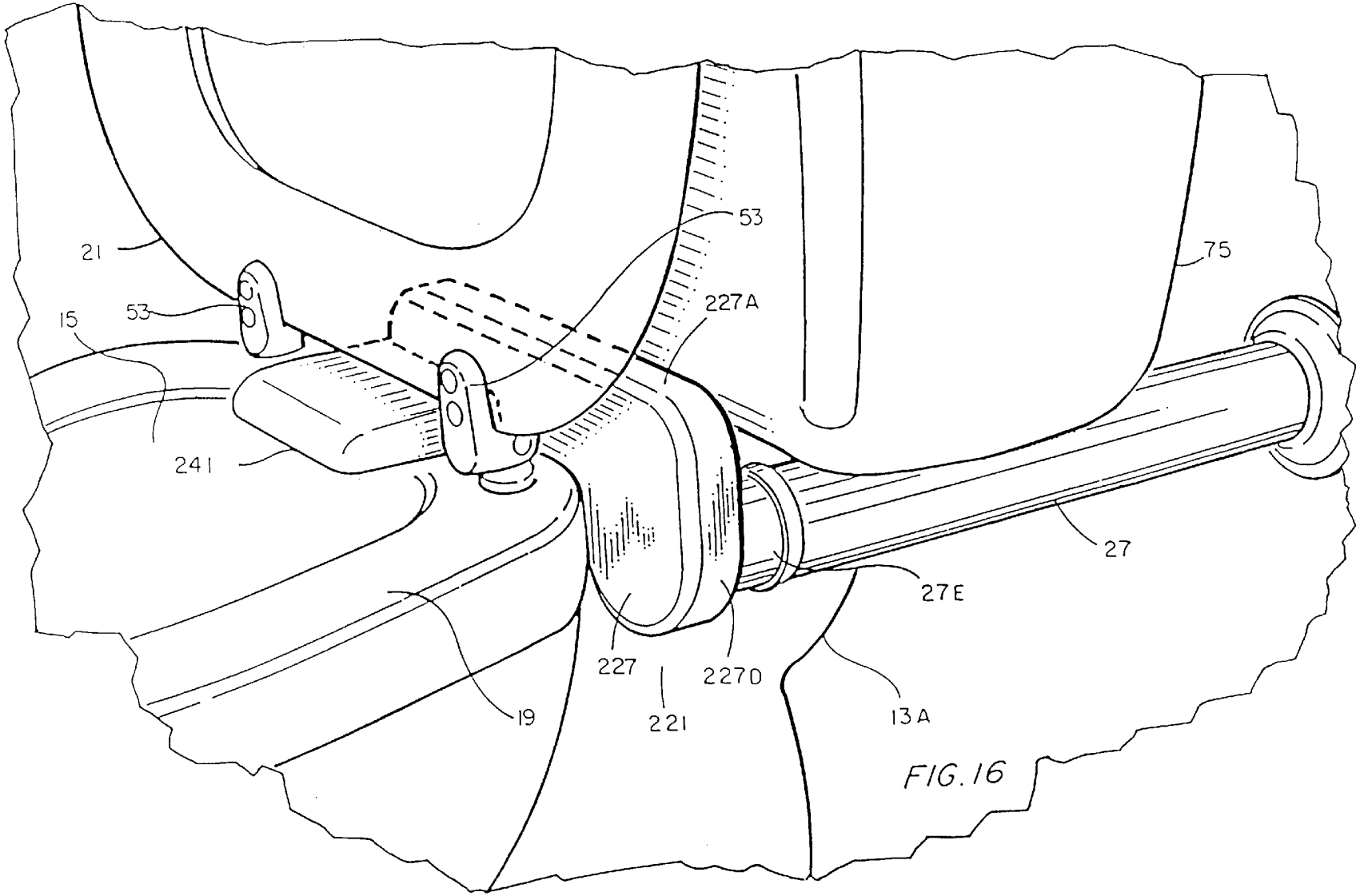
FIG. 16 is a partial view of FIG. 14 with the seat secured to the toilet.

Referring now FIGS. 9–11, the manifold 221 is formed of two L-shaped members 225 and 235. Member 225 has an elongated portion 225A and a transverse portion 225B. Member 235 has an elongated portion 235A and a transverse portion 235B. Member 225 has a front wall 227 with an inlet opening 229 formed therethrough and surrounded by a forward extending sleeve 231. Upper, lower, and opposite side walls 227A–227D extend rearwardly from front wall 227. Member 235 has a rear wall 237 with a round outlet opening 239 formed through its transverse portion. Upper, lower, and opposite side walls 237A–237D extend forwardly from rear wall 237. Walls 237A–237D of member 235 removably and slidably fit within the walls 227A–227D of member 225 to form an L-shaped manifold as shown in FIGS. 14–16 with a hollow interior 221(I). The two members 225 and 235 can be separated in order to facilitate cleaning of the insides thereof.

The intake 241 comprises top and front walls 243 and 245 with two side walls 247 and 249 deferring a cavity 251. The rear portion of intake 241 removably fits within the sleeve 231 to provide an air and odor flow path from the cavity 251 to the interior 221(I) of manifold 221 by way of inlet opening 229, and from the interior 221(I) of manifold 221 by way of outlet opening 239. A ridge 241R limits inward movement of the intake 241 in the sleeve 231.

Members 225, 227, and 241 may be formed of a suitable plastic.

The round end 27E of the exhaust pipe or conduit 27 removably fits within the outlet opening 239 to allow the manifold 221 to rotate about the conduit 27 when the intake 241 is removed from the sleeve 231. The manifold 221 can be removed from the exhaust 27 and disassembled for cleaning purposes.

Figure 17:
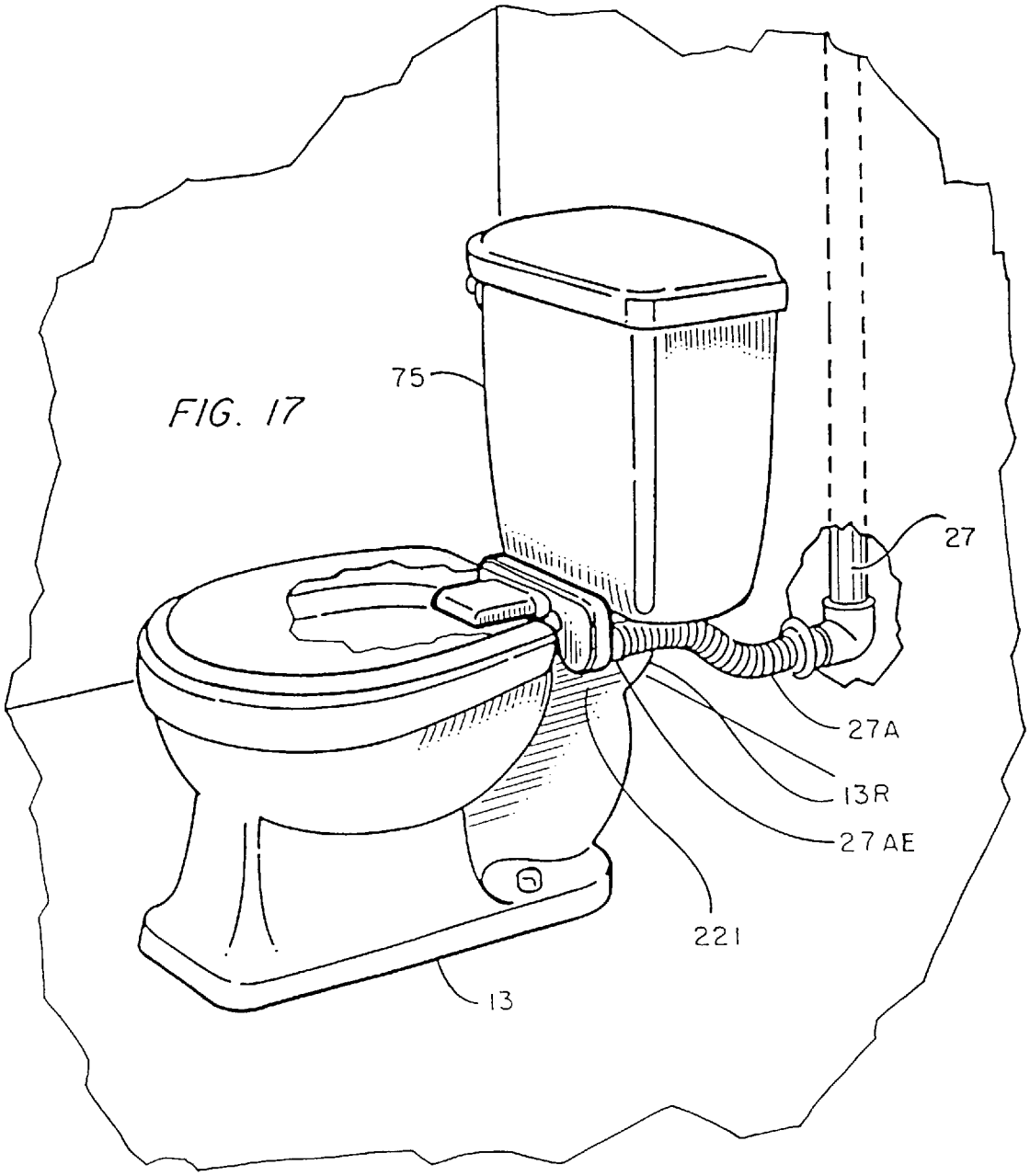
FIG. 17 is a view similar to that of FIG. 15 but with a flexible exhaust conduit in place.
Figure 18:
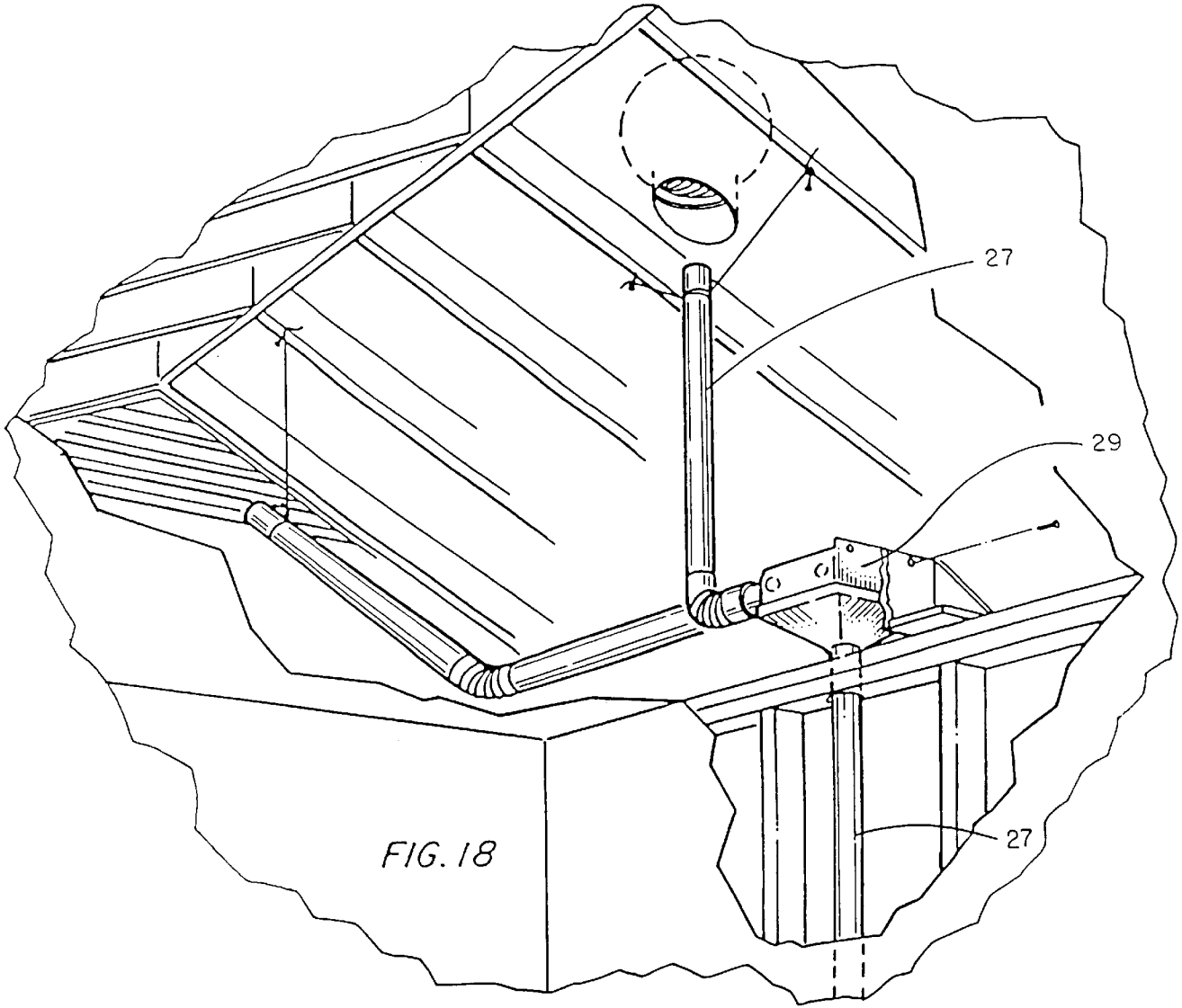
FIG. 18 illustrates the upper portion of the exhaust system used with a toilet ventilation system.
Figure 22:
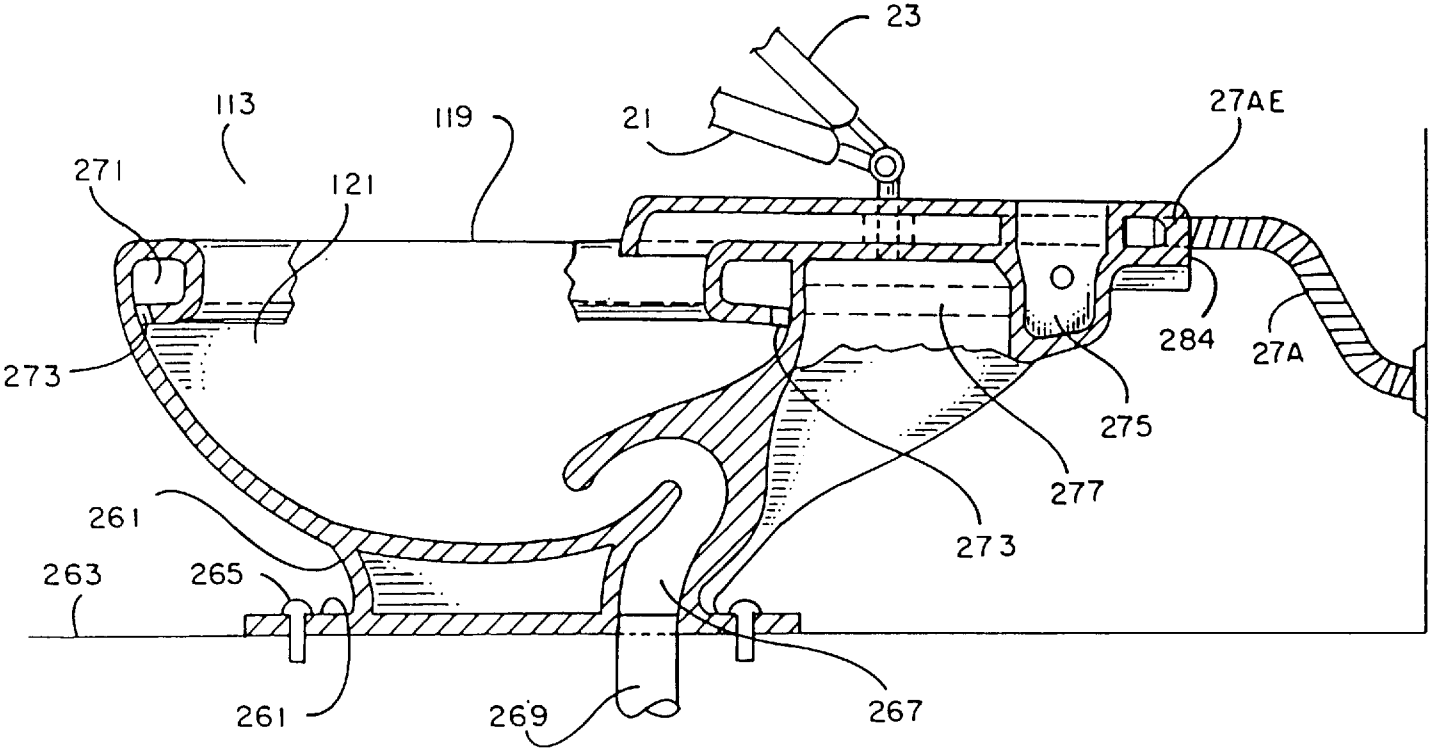
FIG. 22 is a cross-sectional view of the toilet of FIGS. 19–21.

As shown in FIG. 17, the exhaust conduit 27A may be a flexible pipe or conduit having a round end 27AE that removably fits in the outlet opening 239 to allow the manifold 221 to rotate about the end 227AE (when the intake 241 is removed from the sleeve 231) while the manifold 221 is being moved out of the way while connected to the flexible exhaust pipe 27A. The flexible exhaust pipe 27A may be folded to facilitate movement of the manifold away from the toilet. The manifold 221 then may be removed from the exhaust pipe 27A and disassembled from cleaning purposes.

The exhaust pipes 27 and 27A may be formed of a suitable plastic.

Use of the manifold 221 and intake member 241 now will be described. In the operative position, the manifold 221 will be positioned such that its elongated portion is next to and engages the rear rim 19 or portion of the toilet with the inlet 229 located below the rear ends of the seat 21 and lid 23 and between the hinges 53. The transverse portion of the manifold 221 extends downward on one side of the toilet with the outlet 239 located below the water tank 175. The end of the exhaust pipe 27 or 27A then is fitted within the outlet 239. The rear end of the intake member 241 is slid under the rear ends of the seat 21 and lid 23 into the sleeve 231. In this position the lower edges of the side walls 247 and 249 will engage and be supported by the upper surface of the rear portion of the rim 19. The front portion 251F of the cavity 251 extends over the toilet bowl 15 such that a flow path is provided from the toilet bowl to the exhaust pipe 27, 27A by way of the cavity 251 of the intake 241 and the manifold 221.

When it is desired to clean the toilet, intake 241, and manifold 221, the intake 241 is removed from the sleeve 231 of the manifold 221 and the manifold 221 is rotated and moved upward and away from the rear end of the toilet. The manifold then can be removed from the exhaust pipe 27, 27A, disassembled and cleaned. The intake 241 and the toilet can be cleaned. Since the bottom of the intake 241 is open, it can be readily cleaned. The members 221 and 241 then are assembled back in place for use.

Although not clearly shown in FIGS. 15–17, the water tank 175 is supported by the top surface of the rear end 13R of the toilet 13.

Referring now to FIGS. 19–22, the embodiment therein shows the manifold or odor vent integral and molded with the toilet fixture. The toilet comprises a stand or base 261 to be attached to the floor 263 by bolts 265 for supporting the bowl 115 and water tank. The bottom of the bowl has an outlet 267 for receiving the upper portion of a drain 269. The upper rim 119 has a surrounding channel 271 in fluid communication with the cavity 121 of the bowl 115 by way of openings 273 and is in fluid communication with a water inlet 275 by way of channels 277 and passages 277P. The inlet 275 receives water from the water tank when its handle is actuated which is applied to channel 271 by way of channels 277 to flush the toilet. The water and waste products from the cavity of the bowl 121 flow to the drain 269 by way of the outlet 267 when the toilet is flushed. The water tank 175 is supported by the rear upper surface 281 of the toilet which is formed of structure 283 integrally molded or cast to the toilet fixture when the toilet is produced. The structure 283 extends rearward of the rim 119 to a rear end 284 and is supported by the rear end portion 113R. The water inlet 275 extends through the surface 281 and through the structure and is surrounded by an annular wall 285. The structure 283 has a forward extending end portion 287 that extends over the bowl 115 a short distance. A passage or vent 291 extends from forward portion 287 to the rear end 284. The vent 291 has a downward facing inlet 293 above the bowl 115. The vent 291 is rectangular in the plane P (see FIG. 21) an then splits into two paths 291A and 291B around the annular wall 285 which are joined at 291C rearward of the wall 285. An outlet opening 295 extends through the structure 283 from the passage portion 291C rearward to the outside. The exhaust pipe 27 or 27A can be fitted inside the outlet 295 such that an air and odor passage is provided from the bowl 115 to the exhaust pipe by way of the inlet 293, vent 291, vent passages 291A, 291B, and 291C and outlet 295. The annular wall 285 extends between and is sealed to the upper and lower walls 283U and 283L of the passage 291.

Apertures 297 are formed through the upper wall 283U between the side walls 283S and the outer flanges 283F for receiving bolts for securing the hinges 53 of the seat 21 and lid 23.

The toilet 113 including the base 261, bowl 115, rear end 113R, rim 119, and vent structure 283 may be formed of suitable ceramic material as a single integral unit using conventional molding or casting processes.

Referring to FIGS. 23–27 there will be described another ventilating system. Like reference numerals identify the same components as shown in FIGS. 1, 4, and 11–13. The toilet 13 including the tank 75 is a conventional toilet and tank and may be the same as that shown in FIGS. 1 and 4. Referring also to FIGS. 1 and 4, the upper rear portion 19R of the toilet 13, has two holes 501 for receiving bolts 57 for securing hinge members 53 to the rear upper portion 19R for pivotally coupling a seat 21 and a lid 23 to the toilet as shown in FIGS. 1 and 4 rearward of the toilet bowl 15. A space 54 (See FIG. 1) is formed between the hinge members 53 and the rear ends of the seat 21 and lid 23.

Three apertures 503 are formed through the rear portion 19R of the toilet for receiving bolts the 505 for securing the water tank 75 to the rear portion 19R. Members 507 are annular seals and members 509 are nuts. The rear portion 19R also has a cone shaped aperture 601 with apertures 603 leading to channels 605 for receiving water from the tank 75 for application to the bowl 15 for flushing purposes.

The water tank 75 is a conventional tank having a front wall 75F a rear wall 75R, two sides 75S a bottom wall 75B and a removable top. The bottom wall 75B has a lower outlet apertures 75(0) formed there through for the passage of water upon flushing and three apertures 75A (aligned with apertures 503 respectively) for receiving the bolts 505 for securing the tank to the upper rear portion 19R of the toilet. A conventional annular seal 605 is employed for forming a seal between walls 75B and 19R around the apertures 75(0) and 601.

Figure 23:
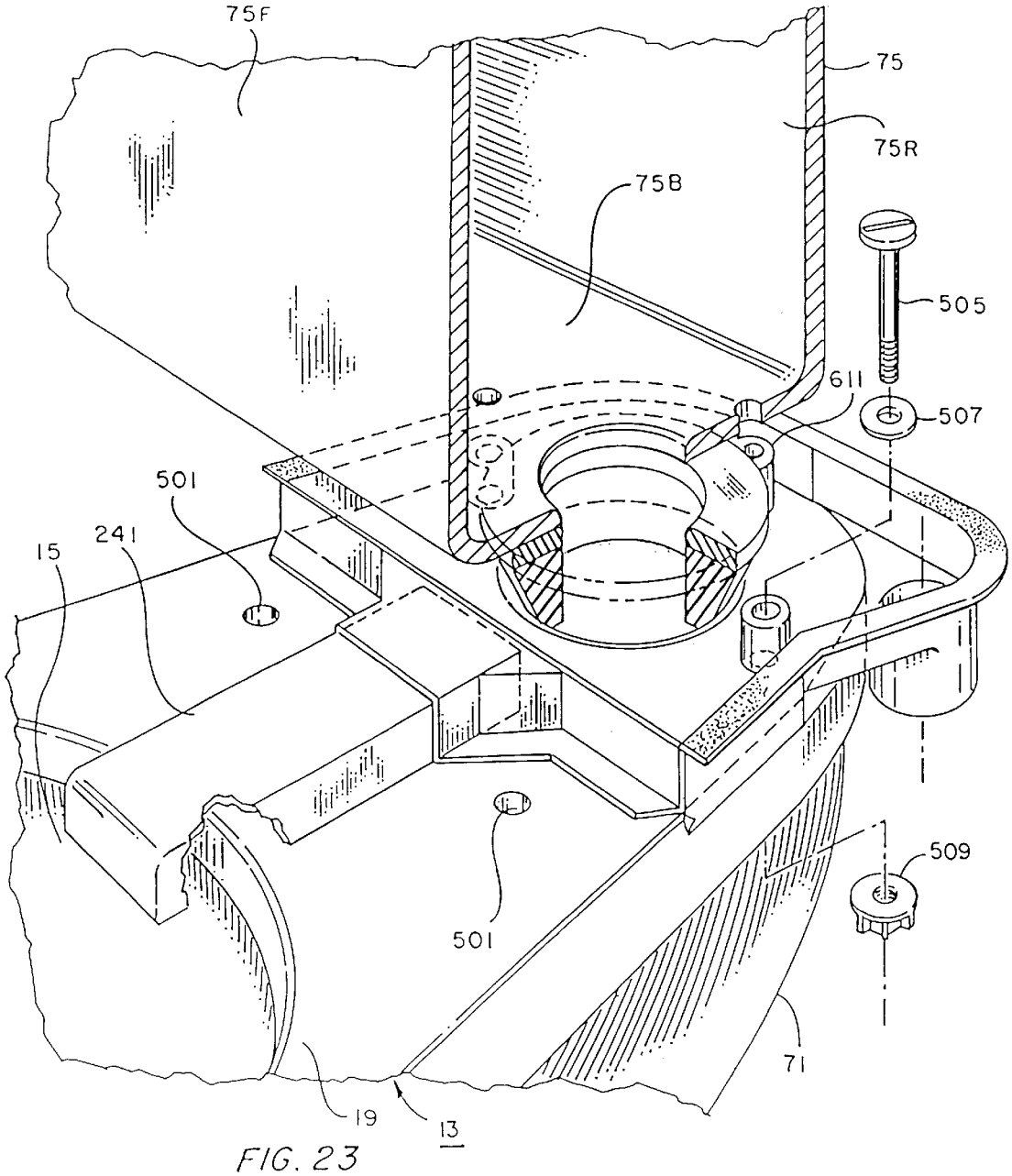
FIG. 23 is an isometric view of another embodiment of a toilet ventilation system.
Figure 24:
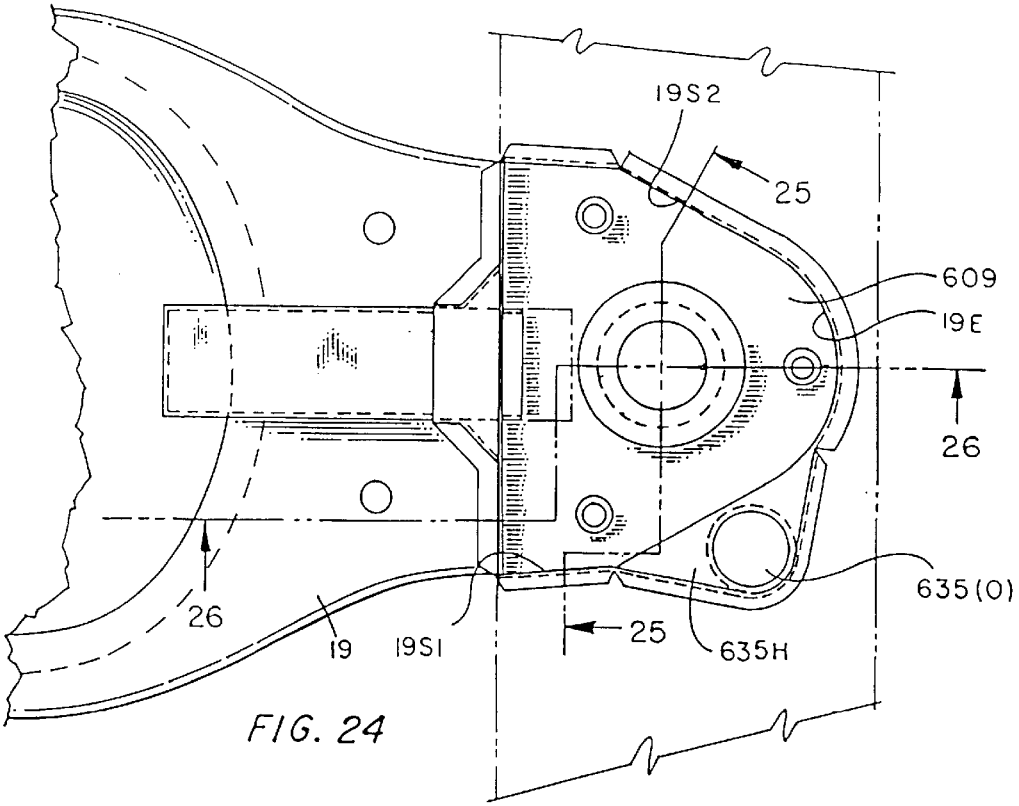
FIG. 24 is a top plan view of a portion of a toilet illustrating the embodiment of FIG. 23.
Figure 25:
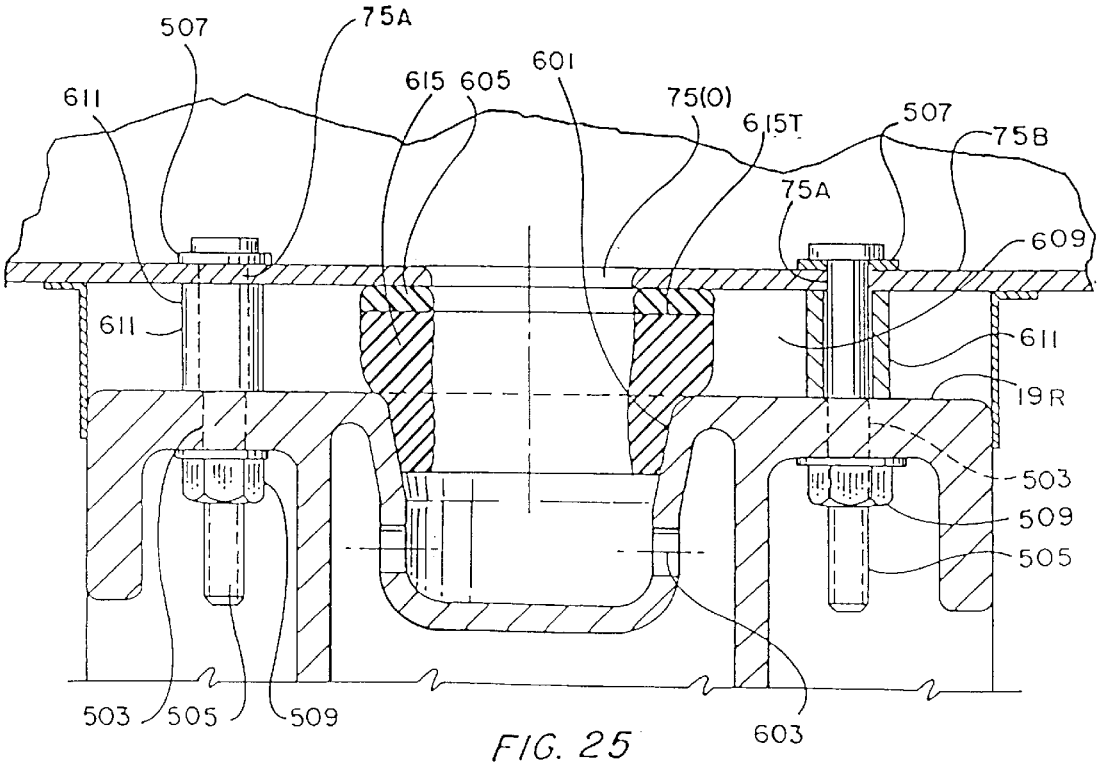
FIG. 25 is a cross-sectional view of FIG. 24 as seen from lines 25—25 thereof.
Figure 26:
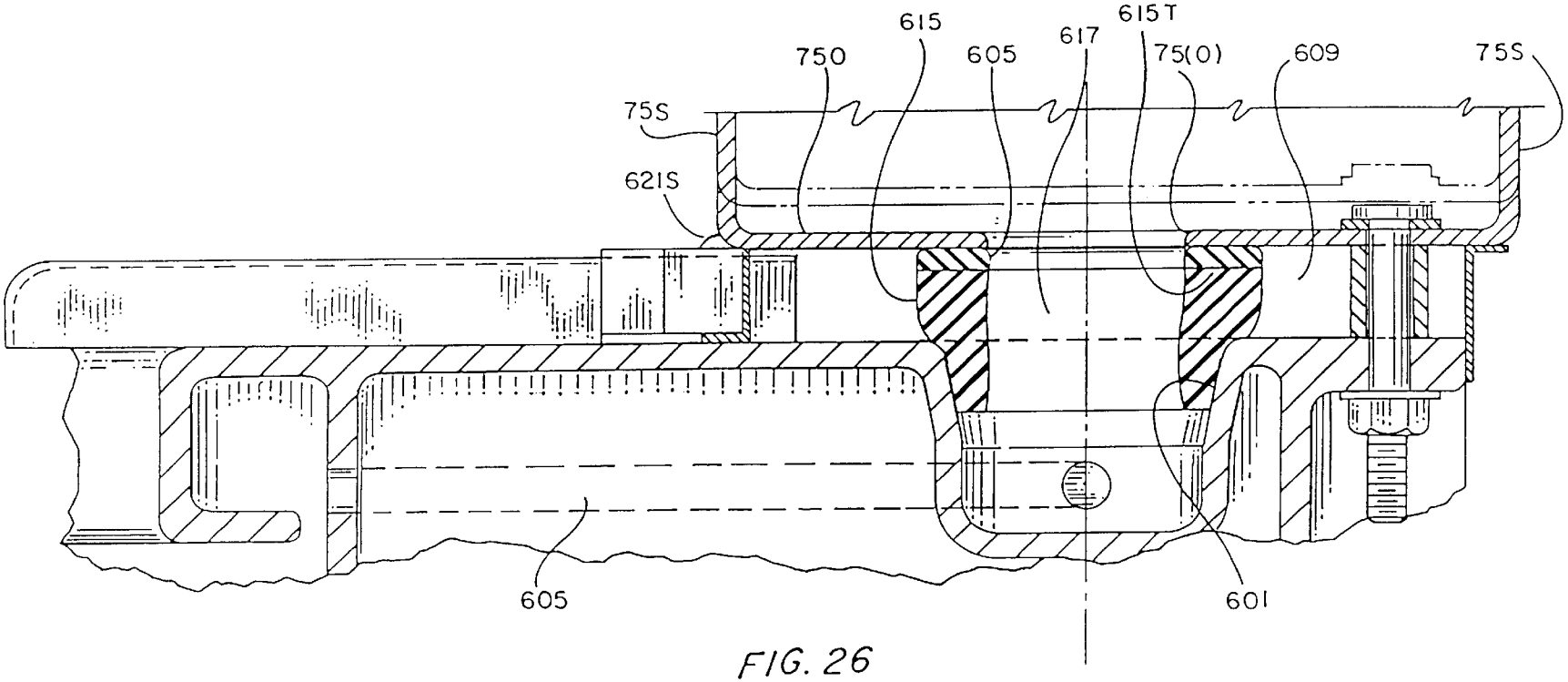
FIG. 26 is a cross-sectional view of FIG. 24 as seen from lines 26—26 thereof.
Figure 27:
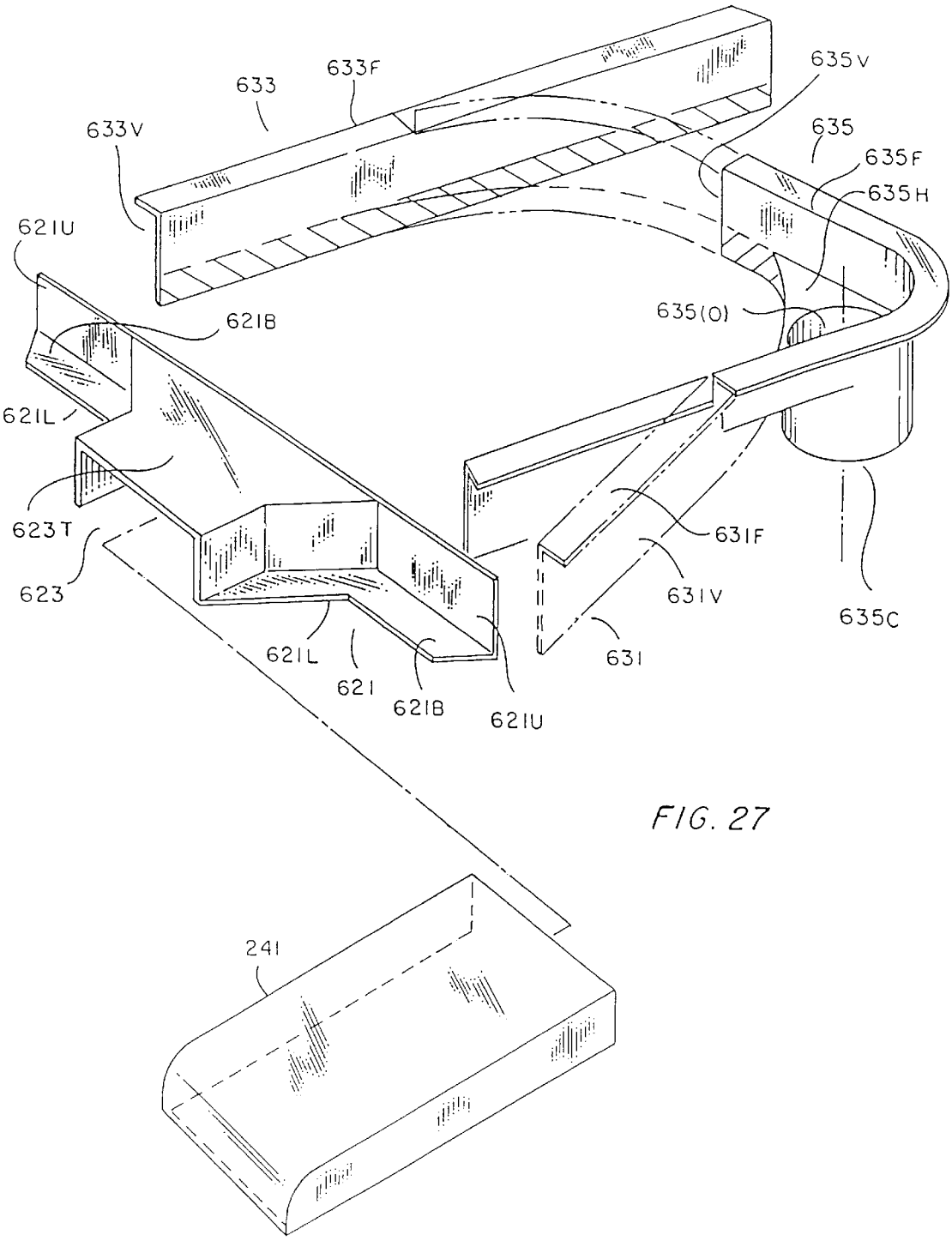
FIG. 27 illustrates the sealing structure of embodiment of FIG. 23.

Three annular spacers 611 for example formed of brass are employed for elevating the bottom 75(B) of the tank 75 above the rear portion 19R of the toilet forming a duct space 609 therebetween. The bolts 505 are extended through the apertures 75A, spacers 611 and apertures 503 and the bolts 505 are secured in place as shown in FIGS. 23, 25 and 26 with the nuts 509. In addition an annular seal 615 having a cone shaped outer surface is located in the aperture 75(0) with the annular seal 605 supported on the top edge 615T for abutting against lower surface of the tank bottom 75B to form water tight passage 617 between the apertures 75(0) and 601. The seal 615 is slightly flexible but rigid and helps support the bottom 75B of the tank 75 in an elevated position.

A relatively stiff front wall 621, having a C-shaped forward extending inlet 623 with L-shaped walls 621L on each side of the inlet 623 is secured to the rear portion 19R of the toilet rearward of the hinges 53 and to the forward lower portion of the front wall 75F of the water tank 75. In this respect each L-shaped wall 621L has a bottom portion 621B and an upward extending portion 621U. The inlet 623 has a top wall 623T with a rear edge in line with the outer wall portions 621U. The undersides of the bottom portions 621B are sealed to the rear portion 19R of the toilet and the upper edges of the outer portion 621U and the rear edge of wall 623T are sealed to the lower surface of the tank bottom 75B with a suitable sealant 621S or with a sealing tape.

The rear portion of the toilet has two sides 19S1 and 19S2 and a rounded rear end 19E defining the shape of the rear portion 19R. Members 631, 633, and 635 are secured to the sides 19S1, 19S2 and end 19E and to the underside of the tank to form a seal along with the member 621 around the duct space 609.

Member 631 is a flexible tape having a vertical portion 631V and an outward extending upper flap 631F. The inside bottom portion of the member portion 631V is sealed with a suitable sealant or glue to the side 19S1 and the upper side of its flap 631F is sealed with a suitable sealant or glue to the underside of the tank bottom 75B. Member 633 is a flexible tape having a vertical portion 633V and an outward extending flap 633F. The inside bottom portion of the member portion 633V is sealed with a suitable sealant or glue to the side 19S2 to and a portion of the end 19E and the upper side of its flap 633F is sealed with a suitable sealant or glue to the underside of the tank bottom 75B. Member 635 is a relatively rigid member having a vertical portion 635V and an outward extending edge 635F. The member 635V is L-shaped when seen in a top plan view. Member 635 also has a horizontal wall 635H extending between the inside of wall portions 635V between edge 635F and its lower edge with a circular exhaust aperture 635(0) formed therethrough. A cylindrical sleeve 635C extend from the wall 635H around the aperture 635(0) forming an outlet sleeve. The inner edge of the wall 645H is sealed with a suitable sealant or glue to the rear portion 19R walls 19E and 19S1 and the upper facing edge 635F is sealed with a suitable sealant or glue to the underside of the tank bottom 75B. Thus the duct space 609 between the elevated tank 75 and the upper rear portion 19R is sealed by the members 621, 631, 633, 635 with an inlet 623 formed in member 621 and an outlet 635(0), 635C formed in member 635.

The intake duct member 241 is the same as that shown and described with respect to FIGS. 11–13. Although not shown in FIGS. 23, 24 and 27, the ridge 241R may be formed on the member. The rear end of the member 241 is slid in the space 54 under the rear ends of the seat 21 and lid 23 on the rim 19 and rear portion 19R into the inlet 623 with the front portion 241F of the cavity of member 241 located over the bowl 15.

Figure 5:
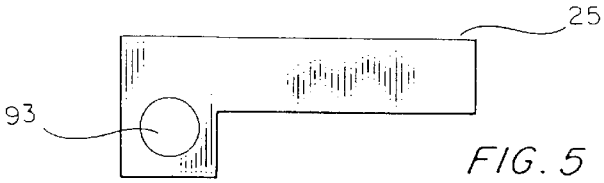
FIG. 5 illustrates the back side of the manifold.

The conduit 27 of FIG. 5 is coupled to the outlet sleeve 635C with the exhaust fan 28 coupled to the conduit 27 for removing odor from the toilet 13 by way of intake duct member 241 and duct space or cavity 609. The duct cavity 609 formed in accordance with the invention is less noticeable and also symmetrical and more appealing in the esthetic sense.

The members 621 and 635 may be made of a rigid plastic and the members 631 and 633 may be formed of a thin flexible plastic. The toilet 13 and water tank 75 may be formed of conventional ceramic material.

Figure 28:
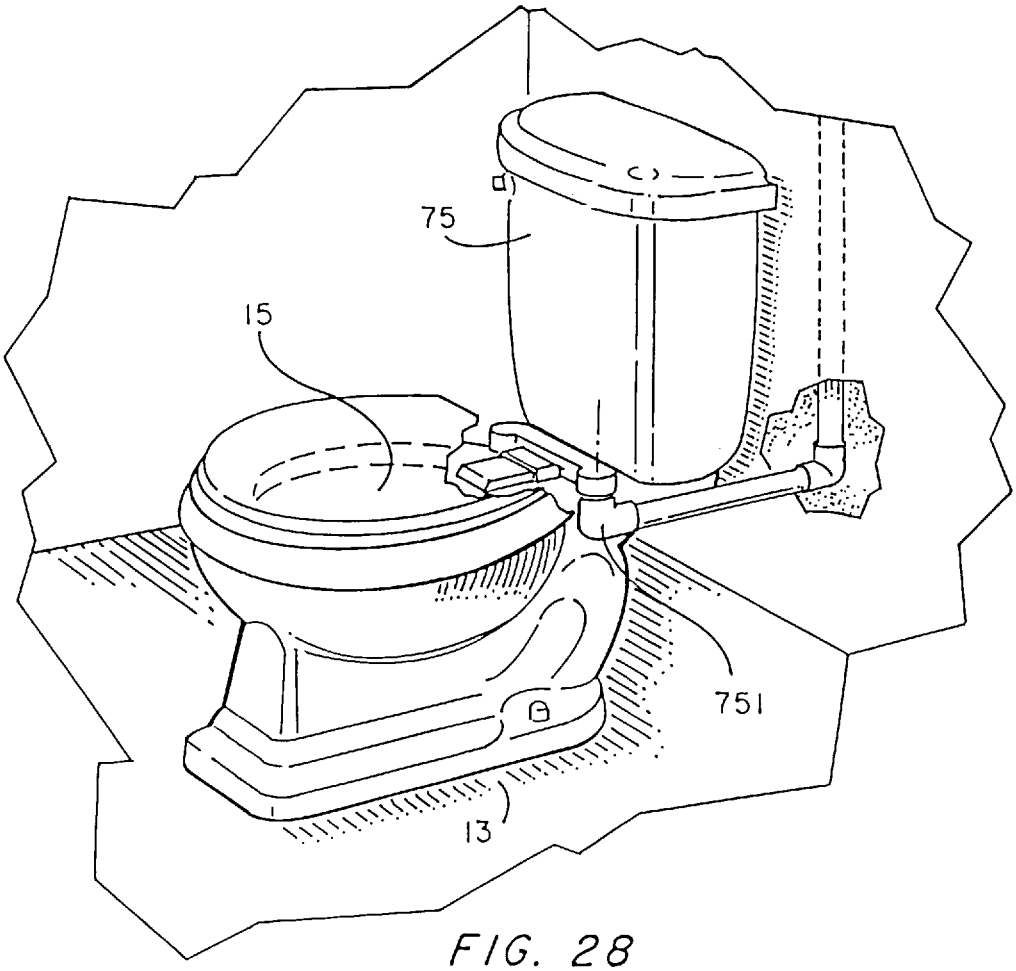
FIG. 28 and 29 illustrates the invention installed on a toilet.
Figure 29:
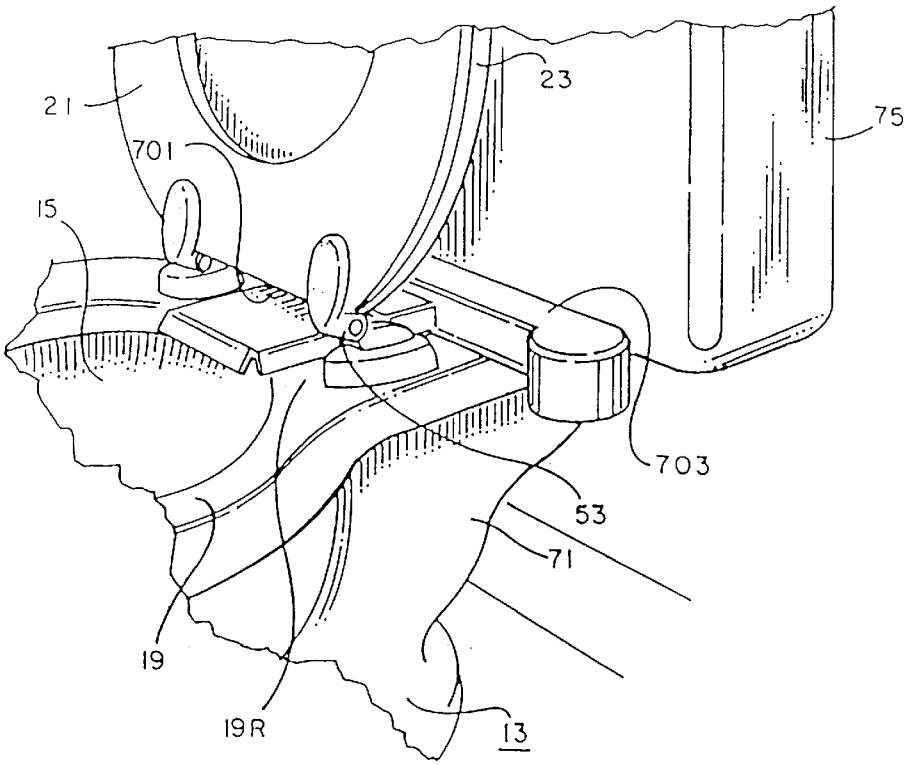
Figure 32:
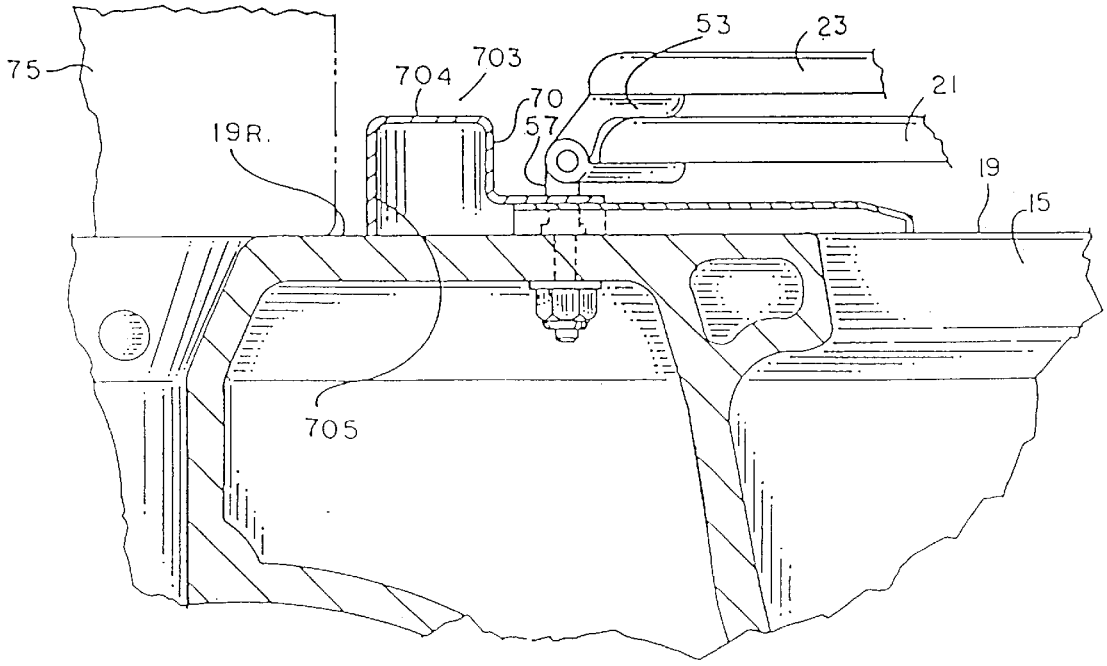
FIG. 32 is a partial cross-sectional view of a toilet illustrating the invention installed on the toilet.
Figures 30, 31, 34, 35, 36, 37:
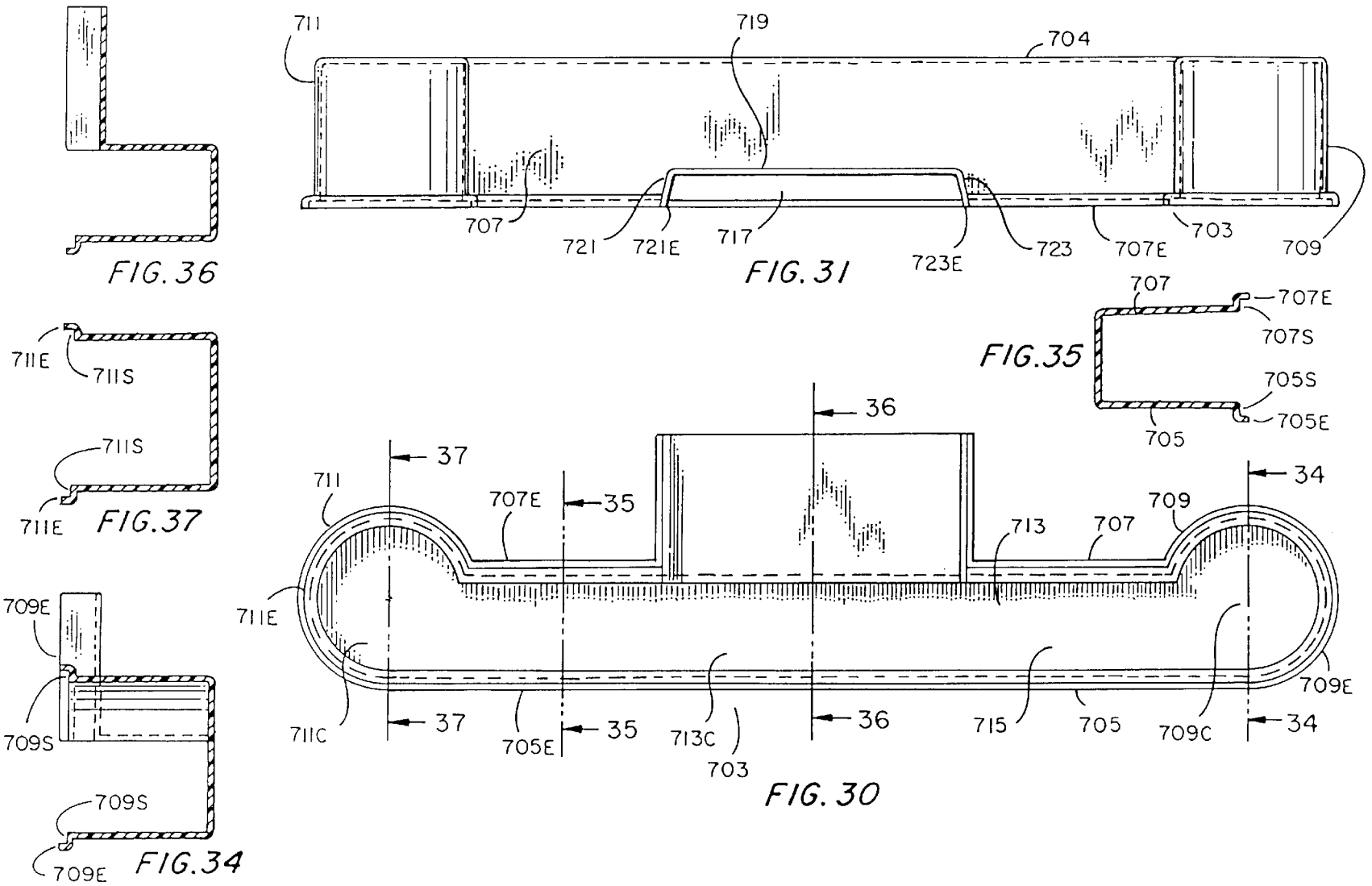
FIG. 30 is a bottom view of the manifold of the invention.
FIG. 31 is a front view of the manifold of the invention.
FIG. 34 is a cross-sectional view of FIG. 30 taken along the lines 34—34 thereof.
FIG. 35 is a cross-sectional view of FIG. 30 taken along the lines 35—35 thereof.
FIG. 36 is a cross-sectional view of FIG. 30 taken along lines 36—36 thereof.
FIG. 37 is a cross-section of a portion of FIG. 30 taken along the lines 37—37 thereof.
Figure 33:
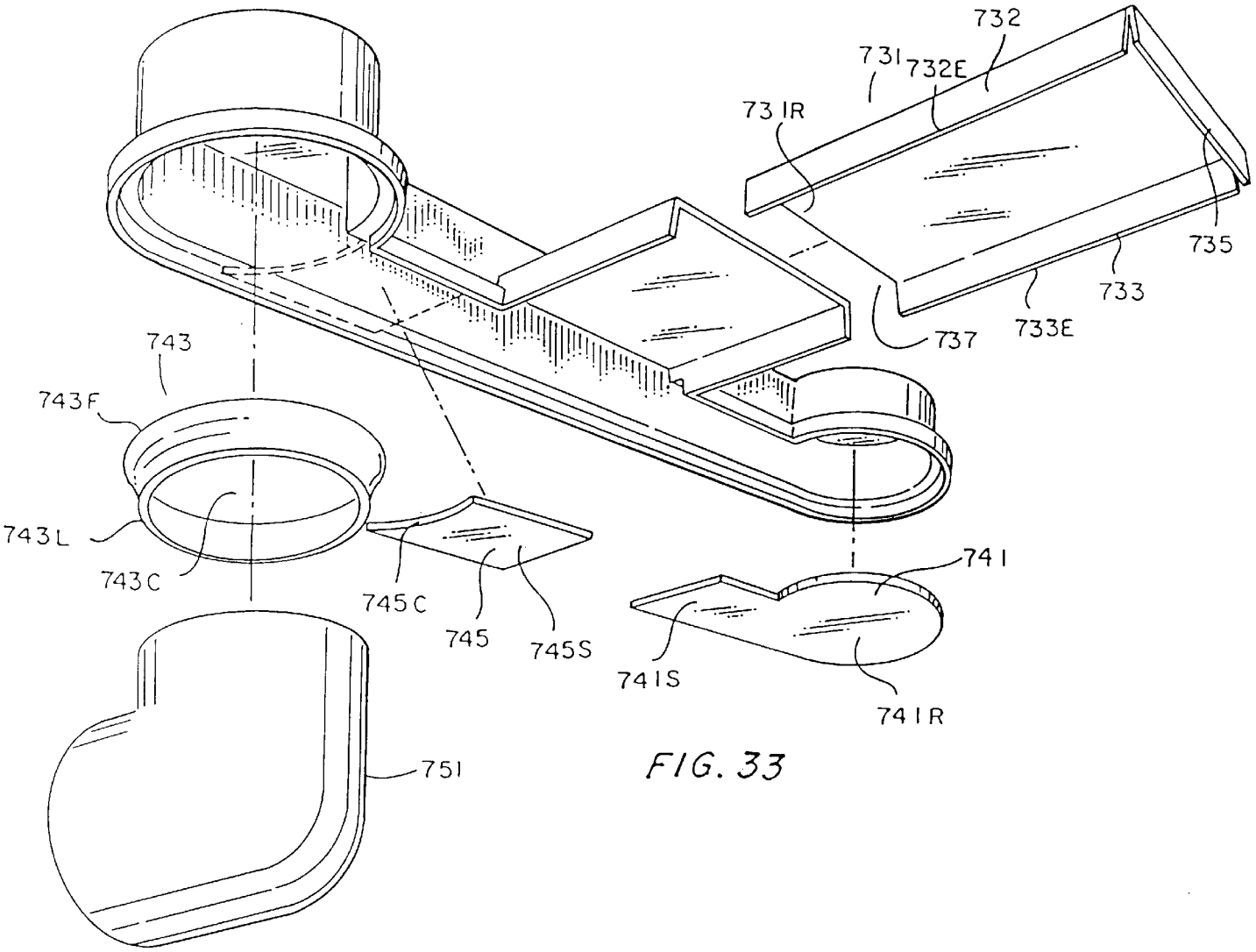
FIG. 33 is an exploded view of the invention.

Referring to FIGS. 28, 29, and 32 there is illustrated a toilet with the invention installed thereon. The toilet is identified by reference numeral 13. It comprises a toilet bowl 15 and an upper surrounding rim 19 leading to a rear upper end portion 19R which supports a water tank 75. The rear ends of a seat 21 and a lid 23 are pivotally coupled to two spaced apart hinges 53 which are coupled to spaced apart bolts 57 coupled to the toilet such that a space 701 is provided between the two hinges 53 and bolts 59, the rear upper portion 19R and the rear ends of the seat 21 and lid 23.

The invention comprises a manifold 703 and an inlet 731. Referring to FIGS. 30–37 the manifold 703 comprises an upper wall 704, a rear wall 705 a front wall 707 and two end walls 709 and 711. The end walls 709 and 711 are partially circular and partially extend forward of the front wall 707. The lower edges 705E, 707E, 709E and 711E of the walls 705, 707, 709 and 711 define a lower opening 713 leading to the interior 715 of the manifold. The opening 713 comprises an elongated central portion 713C and two circular end portions 709C and 711C. The front wall 707 has a front opening 717 formed therethrough from its lower edge. Extending from the front wall 707 around the opening 717 are a forward upper wall 719 and two side walls 721 and 723 which flare outward and downward from the forward wall 719.

The lower edges 705E and 707E of the front and rear walls 705 and 707 are adapted to rest on and engage the upper rear portion 19R of the toilet behind the seat 21 and lid 23 and in front of the water tank 75 with the opening 717 facing forward and with the end walls 709 and 711 located on opposite side and extending beyond the sides of the rear upper portion 19R. In this position, the lower edges 721E and 723E of the forward side walls 721 and 723 also engage the rear top portion 19R of the toilet.

Also provided is an inlet member 731 having two side walls 732 and 733 which flare outward and downward and a front wall 735 which slants forward and downward defining an open bottom with an opening 737 at the rear 731R of the member 731. In use the inlet member 731 is located under the rear ends of the seat 21 and lid 23 with the lower edges 732E and 733E engaging the rear upper portion 19R of the toilet and with the rear end 731R within the forward walls 719, 721 and 723 of the opening 717 and with the front wall 735 located over the toilet bowl 15.

The inlet member 731 can be slide in the opening 717 forward or rearward on the upper rear end 19R of the toilet to position it in the desired position depending on the dimension of the rear upper portion 19R of the toilet from the rim 19 to the tank 75.

The manifold 703 and inlet member 731 are formed of a plastic material such that their walls are relatively flexible. If the height of the rear end of the seat 21 and lid 23 above the rear end portion 19R is relatively low, the inlet member 731 and the forward wall 719 can be pressed down to allow the inlet member 731 to fit under the rear ends of the seat 21 and lid 23. Since the walls 721 and 723 and 732 and 733 flare outward and downward, the height of the inlet member 731 and the forward wall 719 can be readily pushed down to be used on different toilets with different heights of the lower ends of the seat 21 and lid 23 above the upper rear portion 19R of the toilet.

Referring to FIGS. 30, 31, and 33–37 the lower ends of the rear and front walls 705 and 707 and the end walls 709 and 711 have outwardly extended shoulders 705S, 707S, 709S, and 711S from which the lower edges 705E, 707E, and 709E and 711E extend.

Two round inserts or members 741 and 743 are provided to be located in either of the end opening 709C or 711C. Insert 741 is a flat cover insert having a rounded portion 741R and a straight portion 741S coupled thereto. The insert 741 can be located on and glued to the shoulders 705S, 707S and 709S to cover the end opening 709 and a portion of the central opening 713 or flipped and located on and glued to the shoulders 711S and 705S and 707S to cover the end opening 711 and a portion of the central opening 713.

The straight portion 741S has a length sufficient to cover the central opening 713 that extends beyond the side wall of the rear upper portion 19R of the toilet.

The member 743 comprises an annular member having a central opening 743C, an upper flared end 743F and a lower end 743L. The insert 743 can be located in either of the openings 709C or 711C to provide means for coupling an exhaust conduit 751 thereto. The flared portion 743F is supported on and glued to either of the shoulders 709S or 711S at either end and the lower end 743L extends downward to allow the exhaust conduit 751 to be coupled thereto.

Also provided is a third insert or member 745 which is flat and has a concave portion 745C adapted to engage the flared end 743F and a straight portion 745S to cover the central opening 713 that extends beyond the side of the rear upper portion 19R of the toilet. The insert 745 can be flipped and used at either end depending on which end the insert 743 is located. It will engage and be glued to the shoulder 705S and 707E and to the flared portion 743E of the member 743 at either end of the manifold.

Thus the manifold 703 is symmetrical and is pleasing to the eye and yet allows either end to be used for coupling to an exhaust conduit with the other end plugged. It can be readily assembled and installed with the inlet 731, removed, cleaned, and installed after cleaning. The exhaust conduit 751 extends upward in the house or building to an electrically actuated exhaust fan as described with respect to the other embodiments.

I claim:

1. An apparatus for use with a toilet having a toilet bowl with an upper rim and an upper rear portion, a seat having a rear end and two spaced apart members pivotally coupling the rear end of the seat to the upper rear portion of the toilet such that a space is provided below the rear end of the seat and the upper rear portion of the toilet, comprising:

a manifold comprising an elongated member having a front wall, a rear wall, two end walls and a top wall with said front and rear walls having lower edges and said two end walls having lower edges defining a lower opening at said lower edges leading to the interior of said manifold, said lower edges of said front and rear walls being adapted to engage the upper rear portion of the toilet below the seat, a front opening formed through said front wall leading to the interior of said manifold, an intake member adapted to be located in the space below the seat and having an open rear end adapted to be coupled to said front opening of said manifold and an open front end portion adapted to extend over the bowl of the toilet.

2. The apparatus of claim 1 wherein: said intake member comprises:

an upper wall and two spaced apart side walls with lower edges adapted to engage and be supported by the upper rear portion of the toilet.

3. The apparatus of claim 2, wherein:

said side walls of said intake member flare outward from said upper wall of said intake member whereby the height of said intake member may be varied by the application of pressure to said upper wall of said intake member.

4. An apparatus for use with a toilet having a toilet bowl with an upper rim and an upper rear portion, a seat having a rear end and two spaced apart members pivotally coupling the rear end of the seat to the upper rear portion of the toilet such that a space is provided below the rear end of the seat and the upper rear portion of the toilet, comprising:

a manifold comprising an elongated member having a front wall, a rear wall, two end walls and a top wall with said front and rear walls having lower edges and said two end walls having lower edges defining a lower opening at said lower edges leading to the interior of said manifold, said lower edges of said front and rear walls being adapted to engage the upper rear portion of the toilet below the seat, a front opening formed through said front wall leading to the interior of said manifold, an intake member adapted to be located in the space below the seat and having an open rear end adapted to be located in said front opening of said manifold and an open front end portion adapted to extend over the bowl of the toilet, at least two members adapted to be coupled to the lower edges of either of said two end walls, one of said members being a closure member to close the lower opening at one of said ends of said manifold and the other of said members being a coupling member adapted to be coupled to an exhaust conduit.

5. The apparatus of claim 4 wherein said intake member comprises:

an upper wall and two spaced apart side walls defining a lower opening with lower edges adapted to engage and be supported by the upper rear portion of the toilet.

6. The apparatus of claim 5, wherein:

said side walls of said intake member flare outward from said upper wall of said intake member whereby the height of said intake member may be varied by the application of pressure to said upper wall of said intake member.

7. The apparatus of claim 6, wherein:

said lower opening comprises an elongated central opening and two opposite end openings, each of said end opening have the same shape, each of said members being shaped to be coupled to either of said end openings.

8. The apparatus of claim 7, wherein:

each of said end openings is generally circular in shape.

9. The apparatus of claim 8, wherein:

said closure member comprises a generally flat member having a circular portion and an extending portion extending from said circular portion such that said circular portion may be coupled to either of said end openings and said extending portion may be coupled to a portion of said lower central opening, said coupling member comprises an annular member having an upper portion adapted to be coupled to either of said end openings and a lower extension adapted to be coupled to an exhaust conduit.

10. The apparatus of claim 9 wherein:

a third member, having a concave end for engaging said coupling insert and for covering a portion of said central opening.

11. The apparatus of claim 4, wherein:

said front opening of said front wall of said manifold comprises a forward upper wall and two spaced apart forward side walls extending forward of said front wall of said manifold with said forward side walls having edges adapted to engage and be supported by the upper rear portion of the toilet.

12. The apparatus of claim 11, wherein:

said forward side walls flare outward from said forward upper wall whereby the height of at least a forward portion of said forward upper wall may be varied by the application of pressure to said forward upper wall.

13. The apparatus of claim 12, wherein said intake member comprises:

an upper wall and two spaced apart side walls defining a lower opening with lower edges adapted to engage and be supported by the upper rear portion of the toilet.

14. The apparatus of claim 13, wherein:

said side walls of said intake member flare outward from said upper wall of said intake member whereby the height of said intake member may be varied by the application of pressure to said upper wall of said intake member.

15. The apparatus of claim 11, wherein said intake member comprises:

an upper wall and two spaced apart side walls defining a lower opening with lower edges adapted to engage and be supported by the upper rear portion of the toilet.

16. The apparatus of claim 15 wherein:

said side walls of said intake member flare outward from said upper wall of said intake member whereby the height of said intake member may be varied by the application of pressure to said upper wall of said intake member.

17. The apparatus of claim 4, wherein:

said lower opening comprises an elongated central opening and two opposite end openings, each of said end opening have the same shape, each of said members being shaped to be coupled to either of said end openings.

18. The apparatus of claim 17, wherein:

each of said end openings is generally circular in shape.

19. The apparatus of claim 18, wherein:

said closure member comprises a generally flat member having a circular portion and an extending portion extending from said circular portion such that said circular portion may be coupled to either of said end openings and said extending portion may be coupled to a portion of said lower central opening, said coupling member comprises an annular member having an upper portion adapted to be coupled to either of said end openings and a lower extension adapted to be coupled to an exhaust conduit.

20. The apparatus of claim 19, comprising:

a third member having a concave end for engaging said coupling insert and for covering a portion of said central opening.

* * * * *